US005835067A

United States Patent [19]

Goodman

[11] Patent Number: 5,835,067

[45] Date of Patent: Nov. 10, 1998

[54] SHORT VERTICAL 160 METER BAND ANTENNA

[76] Inventor: Edward A. Goodman, 3816 Royal La., Dallas, Tex. 75229

[21] Appl. No.: 591,734

[22] Filed: Jan. 25, 1996

Related U.S. Application Data

[63] Continuation-in-part of Ser. No. 234,422, Apr. 28, 1994, abandoned.

[51] Int. Cl.[6] ..... H01Q 9/42

[52] U.S. Cl. ..... 343/722; 343/752; 343/828; 343/830

[58] Field of Search ..... 343/749, 752, 343/745, 722, 828–830; H01Q 9/00, 9/30, 9/32, 9/40, 9/42

[56] References Cited

U.S. PATENT DOCUMENTS

| | | | |
|---|---|---|---|
| 3,482,249 | 12/1969 | Mullaney | 343/752 |
| 3,484,787 | 12/1969 | Vallese | 343/752 |
| 3,521,169 | 7/1970 | Turner et al. | 343/752 |
| 3,967,276 | 6/1976 | Goubau | 343/752 |

OTHER PUBLICATIONS

The CTSVR Uni–Hat Antenna McCoy, Lew; CQ, Dec., 1994, pp. 24, 26–28.

*Primary Examiner*—Michael C. Wimer
*Attorney, Agent, or Firm*—Maxwell C. Freudenberg; Kenton L. Freudenberg

[57] ABSTRACT

A physically short broad-bandwidth multiband vertical antenna with 50 ohm input impedance and 25 foot square footprint for 160, 80, 40 and 17 meter radio bands. Low ohmic resistance due to the small physical size combined with system impedance transformation and capacitive input coupling provide radiation resistance corresponding to an efficiency of about 85 percent. The 2:1 SWR bandwidth is 50 kHz on 160 meters and 87 kHz on 80 meters. A 30 foot mast, top hat capacitive load, and a plurality of parallel vertical skirt wires depending from the top hat around the mast are electrically connected together at the top of the mast. An impedance transforming multi-tap coil is connected between mast and ground. Skirt wires are in two sets separately fed at their lower ends by separate coaxial cable coupling capacitors for operation on different bands. A 50 ohm feed line, skirt wires, coupling capacitors and impedance transforming coil all have terminal connections on a mast-base insulator. End-pruning of coaxial cable capacitors combined with coil tap selection tunes the antenna for desired portions of the 160 and 80 meter bands for input impedance matching without additional matching devices. Skirt wire sets, downwardly tensioned and spaced from the mast, are connected to input capacitors by separated crossed metal spreaders at the mast-base insulator. Additional reactance-reducing components facilitate improved operation at 40 meters. More independent center frequency tuning for both 160 and 40 meter bands is obtained by connecting the impedance transformation coil from ground to a higher point on the mast via an additional skirt system.

37 Claims, 29 Drawing Sheets

11
11
20
INNER
LOOP 13
10
INDEX RADIAL
INDEX POSITION
9
MAST EXTENDER
ROD 17
19
18
20
SKIRT "A"
A
20
SKIRT "B"
16U
20
2

SHORT VERTICAL 160 METER BAND ANTENNA

This is a continuation-in-part of application Ser. No. 08/234,422 filed Apr. 28, 1994 abandoned.

The present invention relates to a vertically oriented folded monopole antenna system with the radiating elements extending perpendicularly to the horizontal earth's surface and providing what is referred to as vertically polarized radio waves.

More particularly the invention relates to a physically short vertical highly-efficient broad-bandwidth multiband antenna which can be erected within a 25 foot square for operating on 160, 80, 40 and 17 meters amateur radio bands. It is supported by a guyed 30 foot mast having a top hat capacitive load. The principal radiators are a plurality of parallel bottom fed vertical skirt wires depending from the top hat and uniformly spaced around the mast. The mast base is electrically isolated from ground by a short insulating mast support member on which is wound an inductive multi-tap coil connecting the mast to ground. The skirt wires are in two sets separately fed at their lower ends from a 50 ohm feed line by separate coaxial cable coupling capacitors. The feed line, coupling capacitors and coil are all interconnected via connectors on the insulating mast support member at ground level for simplified assembly, low ohmic losses due to short electrical connections and convenience in changing antenna system parameters. The coaxial cable capacitors are trimmed in length and combine with coil tap selection to tune the antenna for desired portions of the 160 and 80 meter bands with optimum impedance matching to the feed line without additional matching devices such as transformers or adjustable couplers. Separated crossed metal spreader tubes supported by the insulating support member couple the capacitors to lower ends of the skirt wires and keep these lower ends downwardly tensioned and spaced from the mast. Adding a series trap between the mast and one skirt wire enables operation on 40 meters. By means of other similar series traps operation can be attained on other frequency bands not harmonically related to the 160 and 80 meter bands. In another embodiment 40 meter operation is achieved using an additional skirt system.

Conventional shortened vertical antennas which are less than one quarter wavelength in height have a capacitive reactance which is typically compensated for by providing an inductive loading coil, the coil often being located between the antenna and ground. Although the present invention uses a coil between the antenna mast and ground, this coil provides an impedance transformation primarily to increase the radiation resistance of the antenna and substantially increase its efficiency. The present invention provides an effective radiation resistance which is high. Radiation resistance Rr is the assumed equivalent resistance which would dissipate the power that is actually radiated from the antenna. The ohmic, or heat loss resistance R1, of the present antenna is relatively small, compared to the radiation resistance, so as to be neglected for all practical purposes in determining efficiency.

As is well known, the efficiency of a ground-mounted quarter wavelength or shorter vertical antenna is a function of the loss resistance R1 which includes losses in the conductor, in the matching and loading components and dominantly in ground losses. Typically such antennas are fed at their base where the RF currents are maximum. In contrast to the radiation resistance of shortened quarter-wavelength vertical antennas which is often of the order of several ohms, resulting in very low efficiency, the present invention achieves a relatively high radiation resistance with a resulting high efficiency. The Rr/(Rr+R1) efficiency of the present antenna is estimated to be about 85 to 90 percent. Moreover the radiation resistance of the present antenna is a very significant part of the antenna input impedance so that both antenna efficiency and impedance matching to the feed line are improved by an increase in radiation resistance.

Ohmic losses in the present system as indicated by R1 are kept relatively low in large part due to the significant fact that the high RF currents in the present folded monopole antenna occur at the top of the antenna, remote from ground and from the transformation coil, where the skirt wires are connected to the top of the mast via the top hat structure. High RF current at the top of the antenna also provides an improved radiation pattern, particularly in combination with wave shaping attributes of the top hat configuration. Another ancillary benefit achieved by the elevated high current location of the present invention is that the usual need for an extensive ground system of a large number of well-connected radial conductors, typically found in the prior art and referred to as providing a mirror ground image, is of much less significance with the present antenna.

Not only does the impedance transforming coil increase the radiation resistance Rr, but it makes the value of such resistance a significant factor in the input impedance of the antenna so that the antenna is easily matched to a 50 ohm coaxial feed line without the need for auxiliary matching transformers or matching networks as are typically required between feed lines and shortened vertical antennas. The simplicity of the present antenna, and its minimal use of reactive devices, achieves a wide 2:1 SWR bandwidth on both 160 and 80 meter amateur bands. The 2:1 SWR bandwidth is 50 kHz on 160 meters and 87 kHz on 80 meters. These bands are commonly called "top bands."

Although top hat loading devices are found in the prior art, as are folded monopole antennas using multiple skirt wires, the present invention provides a unique combination of a top hat with a skirt system in which the mutual interaction of these components and the use of multiple sets of skirt wires enables highly-efficient broad-bandwidth multiband operation of an antenna that can be directly matched to a 50 ohm feed line without the need for additional transformers or matching devices or coupling networks.

The antenna is resonant on the intended frequency of operation as a short radiator. The system appears to be resonant due to the impedance transformation network described herein. The impedance transformation network acts as a combination wave guide, radiator and impedance transformer with the capacitive top hat acting as a wave shaper for launching the emitted low angle RF field. The present antenna is believed to accomplish its unique impedance transforming characteristics of operation due to an unusual combination of antenna phenomena mixed with transmission line phenomena or interaction along the mast and skirt wires. The configuration of the top hat relative to the mast and skirt wires is believed to have a radiation shaping effect which produces the desirable lower vertical angle of the radiation field.

The present invention uses multiple sets or pairs A and B of mutually interacting skirt wires to achieve operation on the 160 meter band. The four skirt wires of skirt sets A and B effectively mutually interact so that all radiate on 160 meters. The tuning of the system is such that the sets A and B are intercoupled by a coupling capacitor so that radiation is from both sets A and B on 80 meters.

A feature of the present invention is that although the skirt wires may have an independence from each other from a multiband impedance matching standpoint they are nevertheless mutually coupled on the fundamental operating frequencies.

The features of this invention are applicable to an antenna for both transmitting and receiving RF signals. However, the invention is particularly concerned with the function of the described multiband antenna as a radiating device. Receiving antennas have relatively small RF currents induced therein by received signals and the relative amount of noise with respect to received signal levels may be quite substantial and pose other problems not attendant to mere transmitting of signals at power levels of several kilowatts.

BACKGROUND OF THE INVENTION

It is well recognized that the physical height of a vertical antenna without various forms of special loading devices and with an appropriate ground image is one quarter wavelength for optimum radiation. One standard equation relating length of a full size quarter wavelength vertical radiating element to frequency is Length (feet)=234/freq(MHz) (ARRL Handbook, 1994, p. 17-10). At 1.8 MHz the length would be about 130 feet. Such a long length poses obvious problems for manufacture and installation of such an antenna, particularly where the space available is such as a small residential lot among residential buildings. Known loading devices achieve in various ways an electrical quarter wavelength with various degrees of bandwidth and efficiency of operation in a physically shorter length. Although it is relatively simple to tune and match a short antenna for operation at a single operating frequency, practical operation in amateur radio bands necessitates being able to change frequency over one or more bands of frequencies to communicate with other amateurs. Techniques and equipment are well known for matching a short vertical antenna to a 50 ohm transmission feed line, but sacrifices are made in prior art devices in efficiency and/or bandwidth and in the ability to operate in multiple bands. The present invention avoids the need for such sacrifices.

The present invention is partially derived from a prior art folded unipole or monopole antenna configuration described by Ron Nott in an article Unipole Antennas-Theory and Practical Applications, The ARRL Antenna Compendium, Vol. 2, 1989, pp 36–38. That article describes an antenna used primarily for AM broadcasting having a vertical mast or tower grounded at its lower end and having three or more equally spaced skirt wires parallel to the tower and connected at their upper ends to the tower. The electrically connected lower ends of the skirt wires are electrically separated from the tower and provide the feedpoint for the antenna. Tuning is achieved by several jumpers, or one jumper and a common ring, between the skirt wires and the mast.

The skirt loading technique of the unipole provides the optimum matching range desired, but does not provide the electrical length for the two lower amateur bands of 160 and 80 meters. Prior art capacity top loaded and bottom fed vertical antenna designs lack the efficiencies needed for operating low power (100 Watts maximum) and further lacked sufficient band width, but they did provide short radiators.

COMPARISON OF FOLDED UNIPOLE AND PRESENT INVENTION

The antenna system of the present invention has an electrical length of about 20 degrees as compared with 70 degrees for the unipole. Both are shorter than the 90 degrees electrical length for a typical base matched vertical quarter-wavelength radiator. The input feed systems, impedance matching networks, and skirt systems of the present invention enables multiband operation of the present antenna with optimum impedance matching to a 50 ohm coaxial feed line on all bands.

The matching network for the prior art Nott unipole does not contain a base insulator and integral matching coil and tuning capacitor assembly as does the present invention. This matching coil and the input capacitor network is located within easy reach at the base of the antenna and allows changes in the resonance and feed line impedance matching of the present antenna system to be conveniently made. The mast of the prior art Nott unipole is grounded at its base. On this prior art unipole you would have to add or subtract length from the antenna to accomplish a resonance change. This would entail changing the center pole and skirt wire length. The present antenna can be tuned throughout the low and high bands and at the same time achieve the impedance matching necessary to couple to the 50 ohm coaxial feed line without any change in physical antenna length.

Although the unipole of the Nott article can be tuned to low frequencies in the manner described therein, the bandwidth is relatively narrow enabling only a small change in transmitter frequency before retuning of the antenna is required. In the present invention relatively wide 2:1 SWR bandwidths of 50 kHz on 160 meters and 87 kHz on 80 meters have been demonstrated.

The present antenna system also exhibits resonance and low impedance on higher non-harmonic frequencies. The present antenna system will match into a 50 ohm impedance at 17.5 MHZ and maintain a flat VSWR to 19.0 MHZ making it a good radiator on the 17 meters amateur band. The present antenna system is resonant on the first natural harmonic frequency of approximately 2.5 MHZ and its second and third harmonics with an equally good match to a 50 ohm feed.

The Nott unipole design does not allow for any harmonic frequency operation without a substantial increase in coaxial feed system mismatch. The unipole with its shunt between the center mast and skirt system would not allow the separation or decoupling of the skirt systems to achieve harmonic radiator operation. The present antenna system accomplishes second harmonic operation without any significant de-tuning of the first harmonic or fundamental operating frequency.

While both designs may be scaled for other operating frequencies, the present antenna system has the advantages of harmonic operation, size and feed line matching capabilities. The prior art unipole would double in height to accomplish the same harmonic frequency operation.

The antenna system of the present invention was developed particularly for use on the 160 meter amateur radio band which covers the frequency range of 1.8 to 2.0 MHz. However, the features of this invention are applicable to other frequencies outside of this band where it is desirable or necessary to obtain optimum performance with an antenna which is of very small size compared to a full size quarter wavelength antenna at the operating frequency or frequencies. As will be apparent from the following description of the invention, it has features which enable efficient additional multi-band operation in the 80, 40 and 17 meter bands. The frequency ranges for these three lower wavelength bands are 3.5–4.0, 7.0–7.3 and 18.068–18.168 MHz, respectively.

OBJECTS OF THE INVENTION

The objects of the invention include achieving a physical length for a vertical antenna which is extremely short in comparison to a quarter wavelength of the operating frequency.

Another object is to achieve a small physical size lightweight antenna for a low frequency band of operation such as 160 meters with a very small footprint enabling easy installation on residential lots and requiring not more than an eight foot stepladder for reaching the parts during installation.

Another object of the present invention is to achieve an antenna of such small height and footprint size as to enable it to be readily installed atop a recreational vehicle or on a flat rooftop with appropriate ground plane conductors on the roof.

A further object of the invention is to achieve an antenna of small height which has minimum dependence on the size of or number of radial conductors in its related ground plane construction and which is readily portable.

Among other objects of the invention are to achieve a physically short antenna which is a high efficiency radiator using low loss or no loss components and has a wide 2:1 SWR bandwidth in its selected band portions of operation.

Still other objects of the invention are to simplify the procedure and accessibility for matching and tuning the antenna components and to achieve wide bandwidths for the frequency bands of operation.

Another object of the invention is to achieve an antenna having combined high efficiency, broad bandwidth and optimum feed line impedance matching, especially to a 50 ohm feed line when operating on 160 meters, and particularly without the need for auxiliary transformers and adjustable coupling devices between the antenna and the feed line.

Another object of the invention is to provide a low cost, easily accessible, readily adjustable and weather resistant capacitor assembly for an antenna system meeting other objects of the invention.

Another object of the invention is to achieve a low-cost easily and safely assembled maintenance-free readily portable antenna system configuration.

A further object of the invention is to achieve multi-band operation in a short antenna having distinct physically-similar skirt-wire systems which are individually tuned for optimum operation in different bands and require no changing of the components of the antenna system configuration when changing from one band to another, and to enable shifting from one band portion to another within the same band with minimum component adjustment.

Another object of the invention is to provide an improved multiband multiskirt folded unipole antenna configuration having short vertical radiators and a capacitive input coupling system which facilitates tuning the antenna to operate in multiple bands.

Another object of the invention is to provide an improved multiband multiskirt folded unipole antenna configuration having an improved low cost input coupling capacitor having an increased voltage rating.

Another object of the invention is to provide an improved multiband multiskirt folded unipole antenna configuration having an improved arrangement for coupling an electrically conducting vertical antenna mast structure to ground through an impedance transforming coil electrically connected to the mast structure at a point or height remote from the base of the mast structure.

Another object of the invention is to provide an improved multiband multiskirt folded unipole antenna configuration having a distinct and separately tuned skirt system for at least one additional band of operation of a multiband antenna.

Another object of the invention is to provide an improved multiband multiskirt folded unipole antenna configuration having a distinct impedance-matching input capacitive system for tuning each of at least three skirt systems for at least three respective bands of operation.

Another object of the invention is to provide an improved multiband multiskirt folded unipole antenna configuration having at least one skirt system for one band which is electrically shorter than a skirt system for another lower frequency band.

Another object of the invention is to provide an improved multiband multiskirt folded unipole antenna configuration having at least one skirt system for one band which is mechanically shorter than a skirt system for another lower frequency band.

Another object of the invention is to provide an antenna system for which the total time for installation of ground plane and hardware and for tuning is less than for typical ¼ wavelength tower-based vertical antennas for 160 meters with more complicated ground systems.

DESCRIPTION OF DRAWINGS

FIGS. 28–31 illustrate another embodiment of the antenna having three distinct skirt systems related to three different frequency bands of antenna operation.

FIG. 28 is a perspective view looking down on the lower or base portion of the antenna showing two crossed skirt-tensioning spreader bars and a short cantilevered skirt-tensioning bar.

FIG. 31 is a perspective view looking up toward a mid-portion of the antenna from about the same angle relative to the mast as in FIG. 30C and showing an upper short cantilevered skirt-tensioning bar which is oriented parallel to the short lower cantilevered skirt-tensioning bar of FIG. 30C.

DESCRIPTION OF PREFERRED EMBODIMENT

An antenna system as contemplated by the description of this invention is all of the antenna components connected to the output end of the transmission feed line which extends from the transmitter to the antenna.

As will be seen from the following description of several Figures, there are several principal components of the capacitance terminated short vertical radiator system of the present invention. These are:

1. A ground radial system.
2. A vertical center mast support assembly.
3. Base insulator and load coil assembly supporting the mast.
4. A capacity top hat atop the mast.
5. Two sets of wire skirts A and B depending from top hat.
6. Skirt wire spreaders and input couplers on base insulator.
7. Two coupling capacitors for skirts A and B.
8. Optional mast to skirt series trap T or additional skirt system C for working added band.

Figure 1:
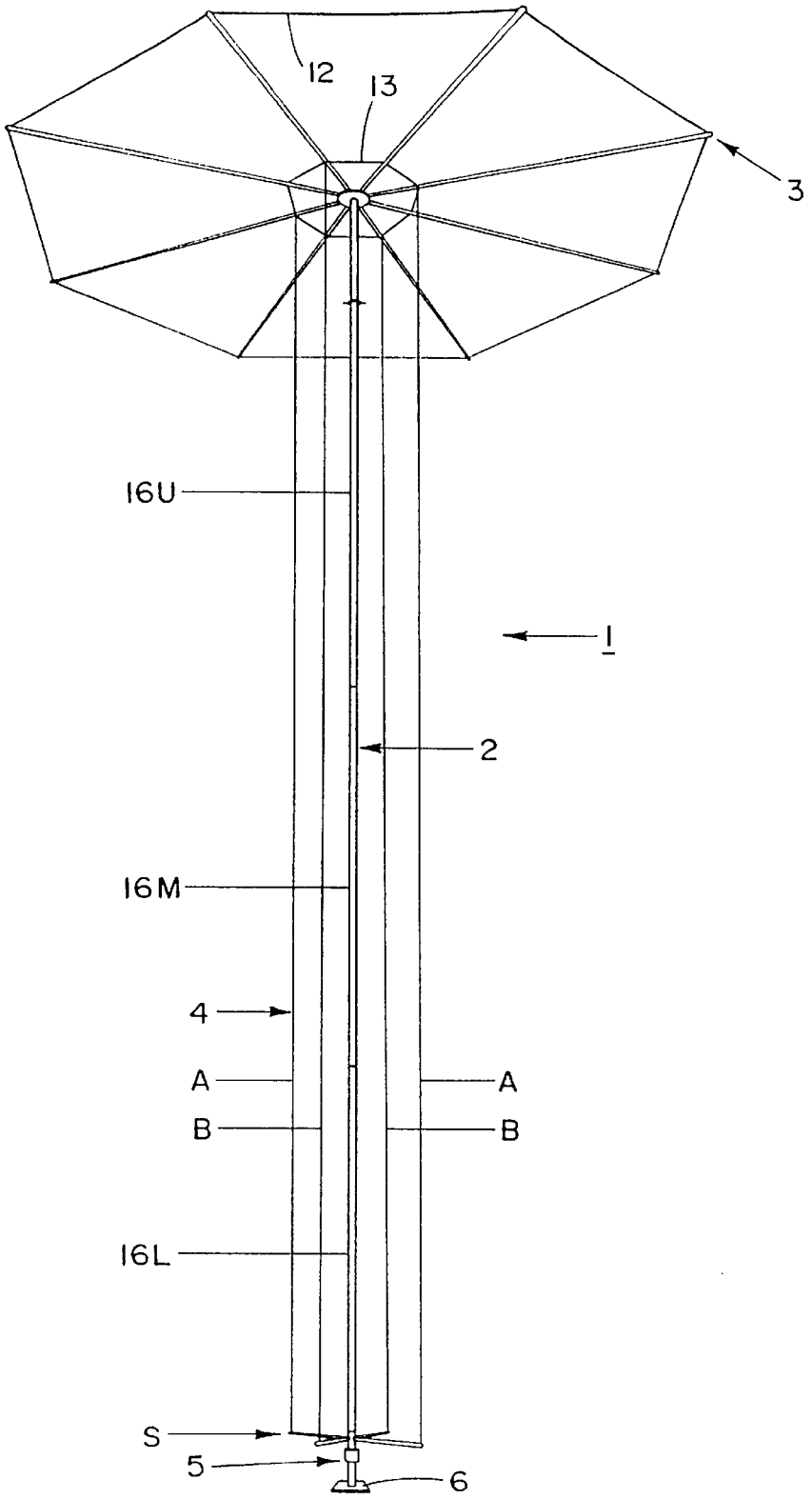
FIG. 1 is a perspective view of the main structural parts of an antenna system taken from slightly above its base and looking upwardly along a mast and multiple skirt wire wires toward a top hat loading structure.

An antenna system in accordance with this invention as seen in FIG. 1 comprises a vertical supporting structure 1 comprising a telescoping tubular metal mast 2. This mast carries at its upper end a metal top hat capacitive loading means 3, shown in detail in FIGS. 3–6, which supports a plurality of parallel vertically extending wires 4 depending therefrom to define a skirt configuration. The skirt wires are equally and uniformly spaced from and around the mast 2 with two of the skirt wires labeled A being located at opposite sides of the mast in a first vertical plane through the center of the mast. The other two skirt wires labeled B are in a second vertical plane through the center of the mast perpendicular to the first plane. These two sets A and B of antenna skirt wires have different feed connections (not shown in FIG. 1) to an antenna feed cable as described hereinafter. The lower ends of the skirt wires are downwardly tensioned by spreader means S (in FIG. 1) described in detail in connection with FIGS. 7–10. This spreader means S is carried by an insulating support assembly means 5 which not only keeps the lower ends of the skirt wires insulated from the mast 2 with skirt wire sets A and B insulated from each other, but also provides vertical support for the mast on a ground plate 6 and carries additional electrical components shown and described in connection with FIGS. 7–12. The mast 2 in combination with the skirt wires performs an impedance transformation for the feed system as well as providing an RF return path for the two sets of skirt wires. The skirt wires, forming the input for the antenna of the present invention, differ from prior art skirt systems not only in being selectively used in one or more sets, especially for multiband operation, but also by achieving the feed system impedance transformation referred to by a unique antenna/transmission-line interaction between the ungrounded mast and the skirt wires.

Figure 11:
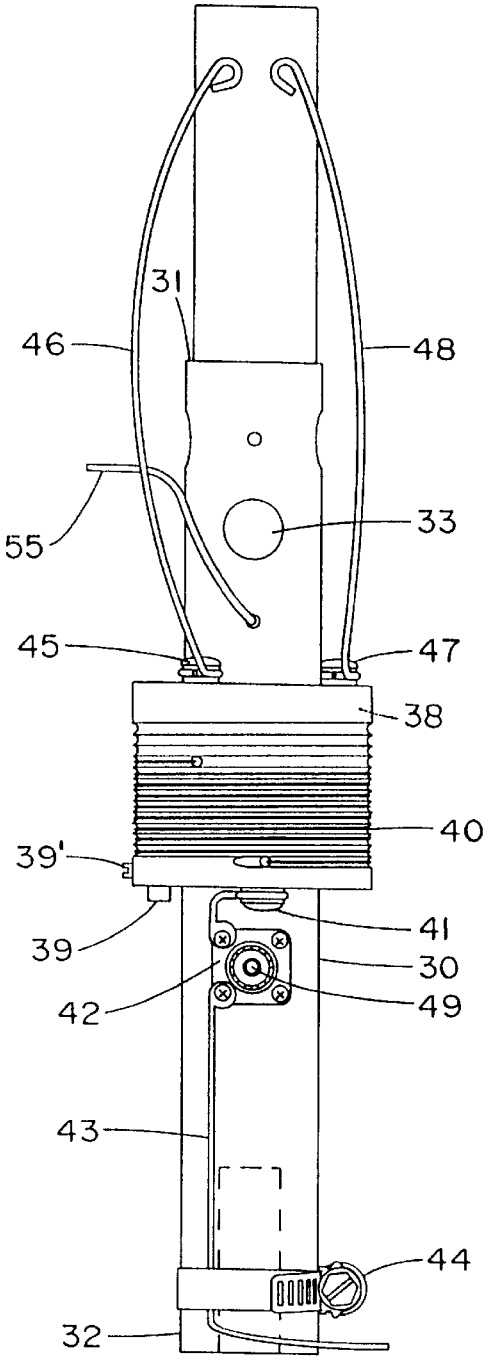
FIG. 11 is a view of the impedance transforming coil structure of FIGS. 7–10 taken from the side to which the input-output coaxial cable is connected.
Figure 12:
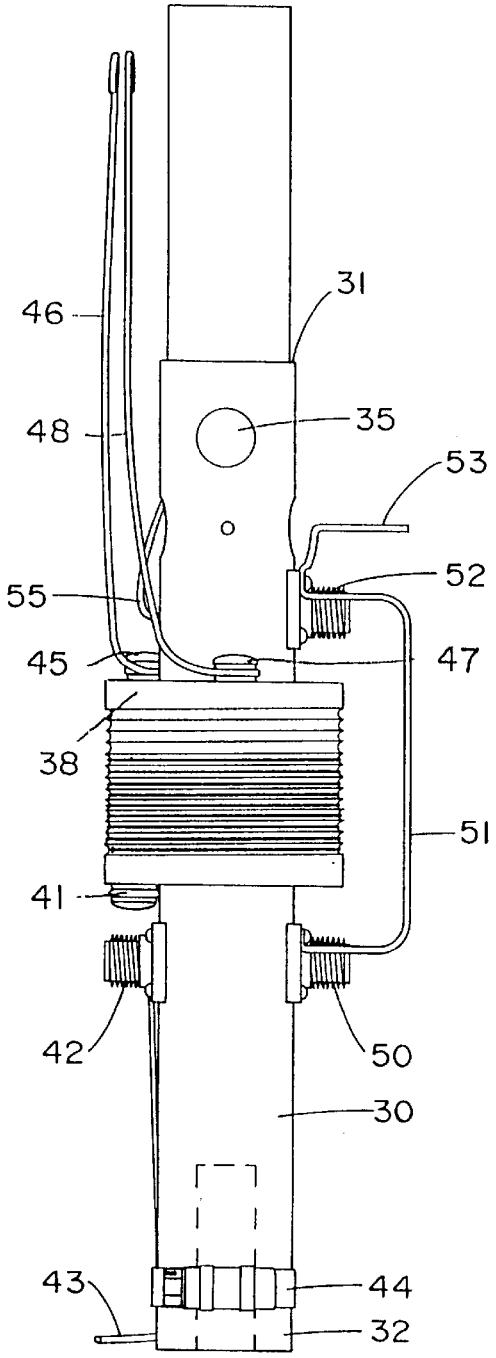
FIG. 12 is a view of the impedance transforming coil structure of FIGS. 7–10 taken 90° from FIG. 11 and showing the input-output coaxial cable connector at the left and two coaxial cable connectors at the right to be connected to two coaxial cable tuning coupling capacitors.

The insulator assembly 5 as seen in FIGS. 11–12 conveniently connects all of the resonant components of the antenna system together in a neat compact package. This assembly is a most important part of the antenna system because it is located conveniently at ground level and is the focal point of all tuning and impedance matching required for the antenna system to correctly function.

Figure 2:
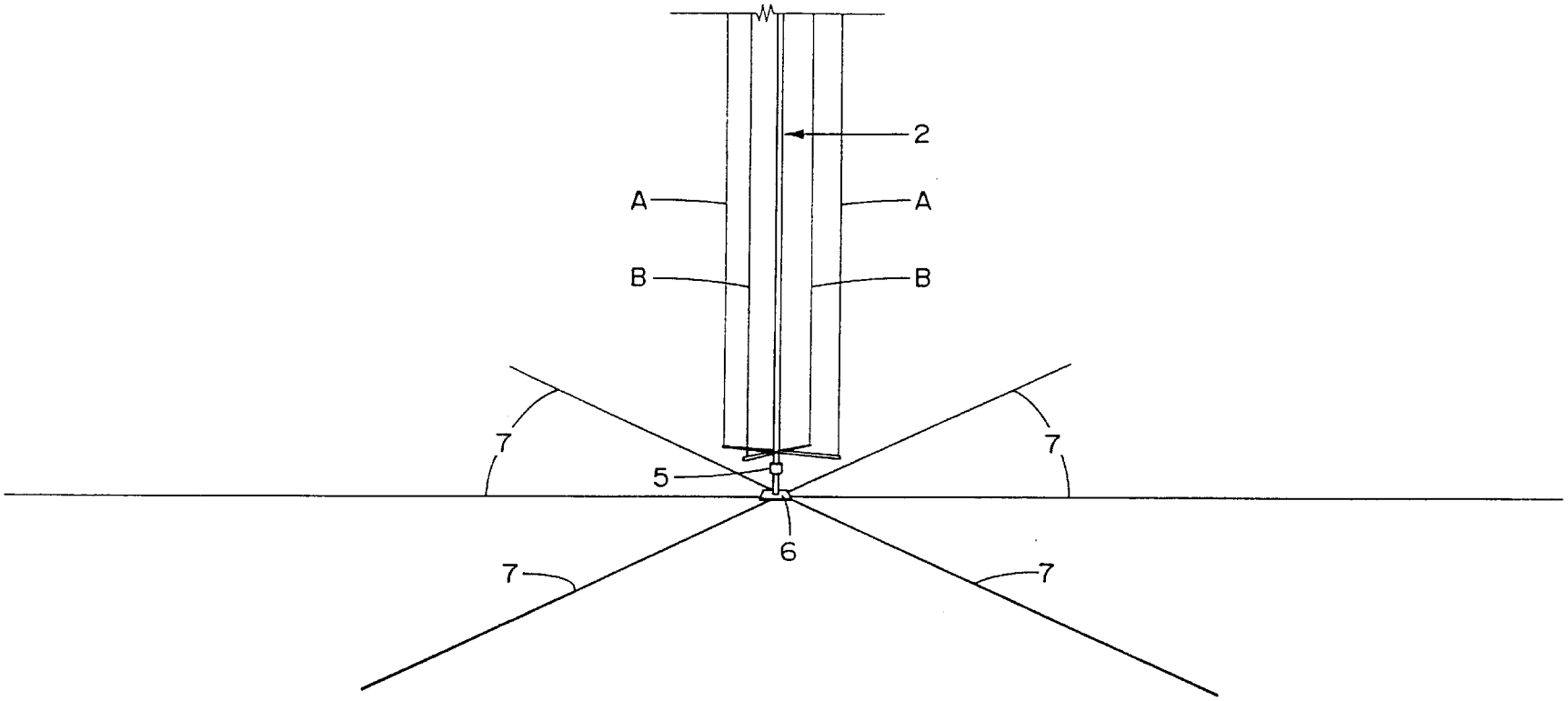
FIG. 2 is a perspective view of the base of the antenna of FIG. 1 with the addition of radially extending wires designating a ground plane.
Figure 9:
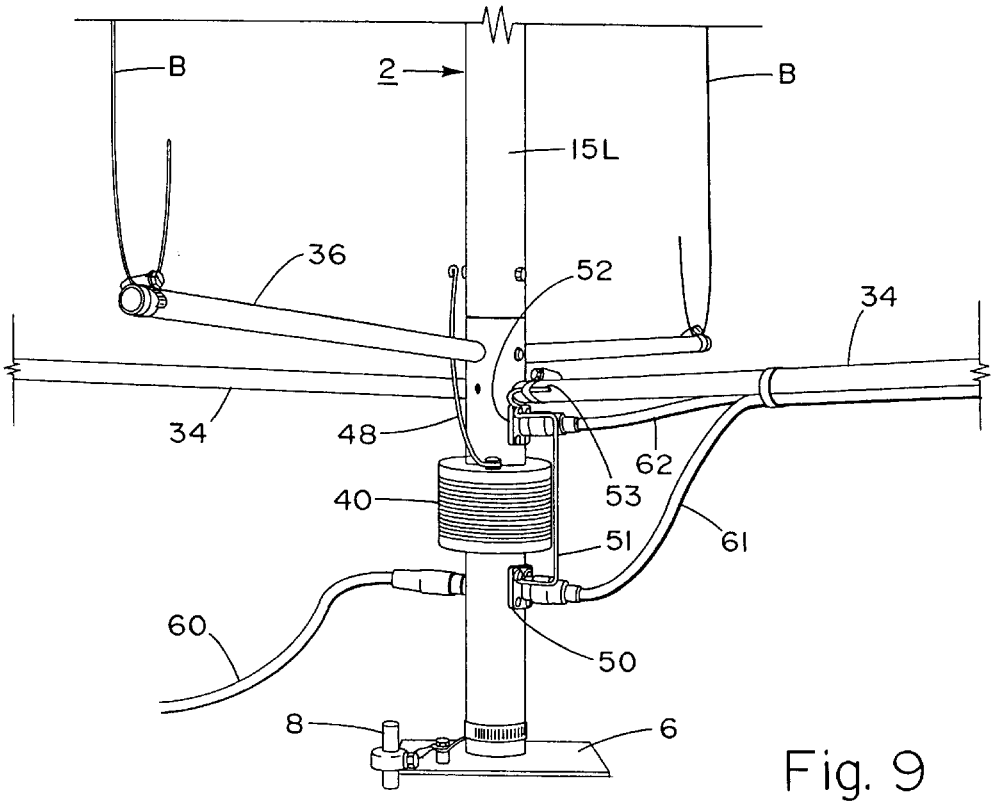
Figure 8:
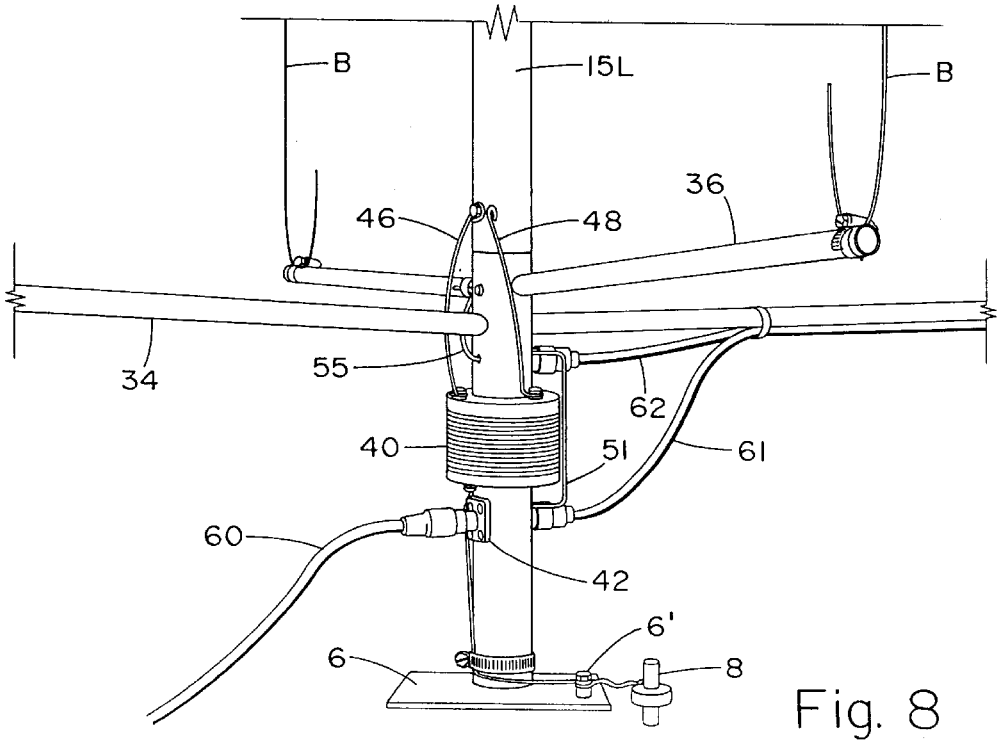
Figure 10:
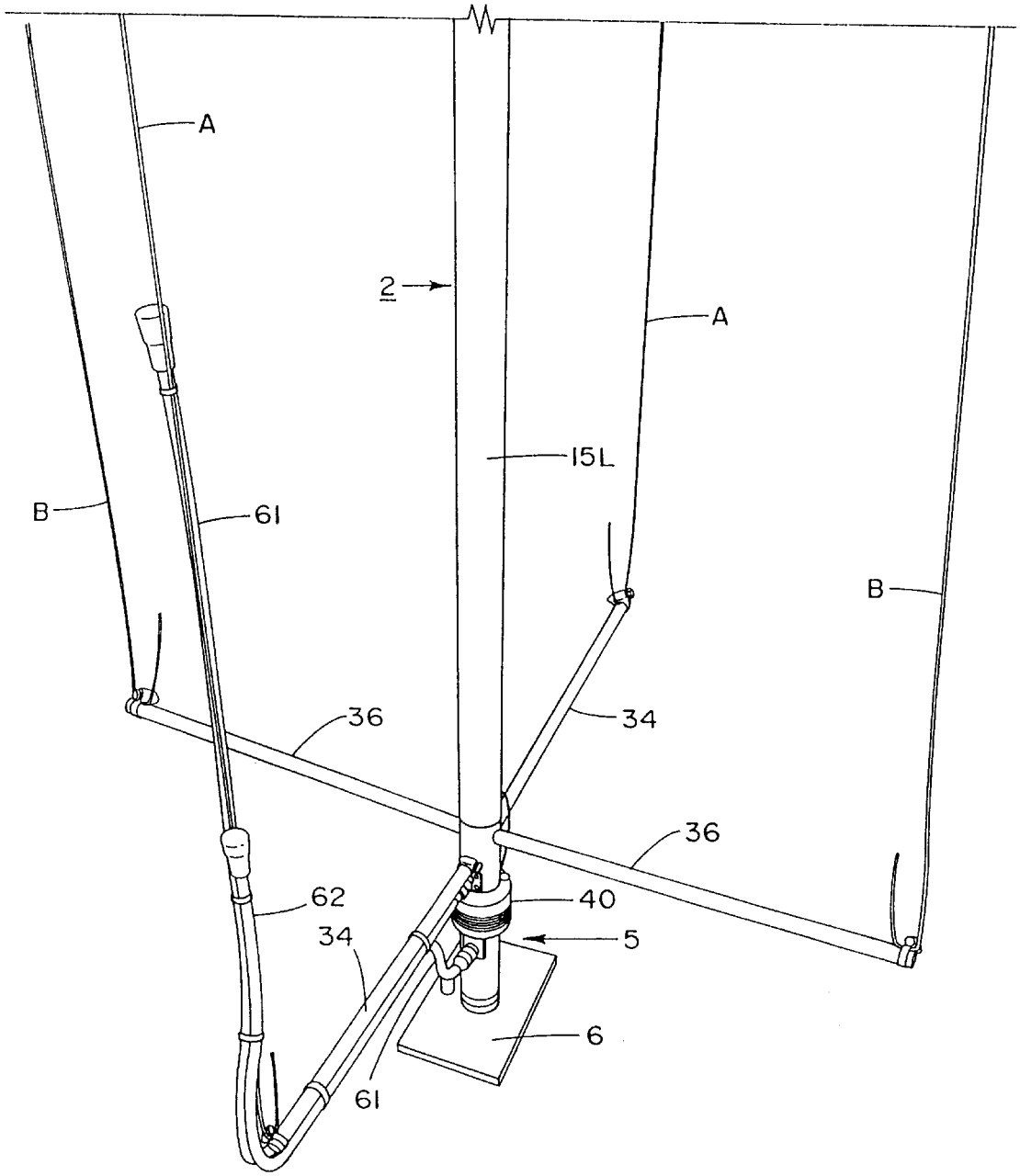

FIG. 2 illustrates a plurality of radially extending insulated #16 stranded ground plane wires 7 lying on or in a surface such as a soil surface to form a ground plane means. There are preferably at least six such wires 34 feet long and uniformly spaced at not more than 60° angles from each other and electrically connected at their inner ends to each other at the ground plate 6 by means of a terminal 6' on the upper surface of the plate 6 which is also connected to the adjacent short exposed end of a vertically extending 8 foot long ⅝ inch diameter copper clad grounding rod 8. The ground rod 8 is completely imbedded in the soil with only a small portion of its upper end exposed as seen in FIGS. 8–9 and connected by an insulated #8 stranded wire to the terminal 6'. Six ground radials is considered an adequate number of radials needed for proper operation of the antenna system. There appears to be no more gain in band width above the six radial count with reasonably good soil conditions under which testing has been done. However, an increase in the number of ground radials decreases the antenna input impedance, but this can be raised again by appropriate adjustment of tuning means (ferrite tuning slug in the coil form 38) described hereinafter.

Figure 3:
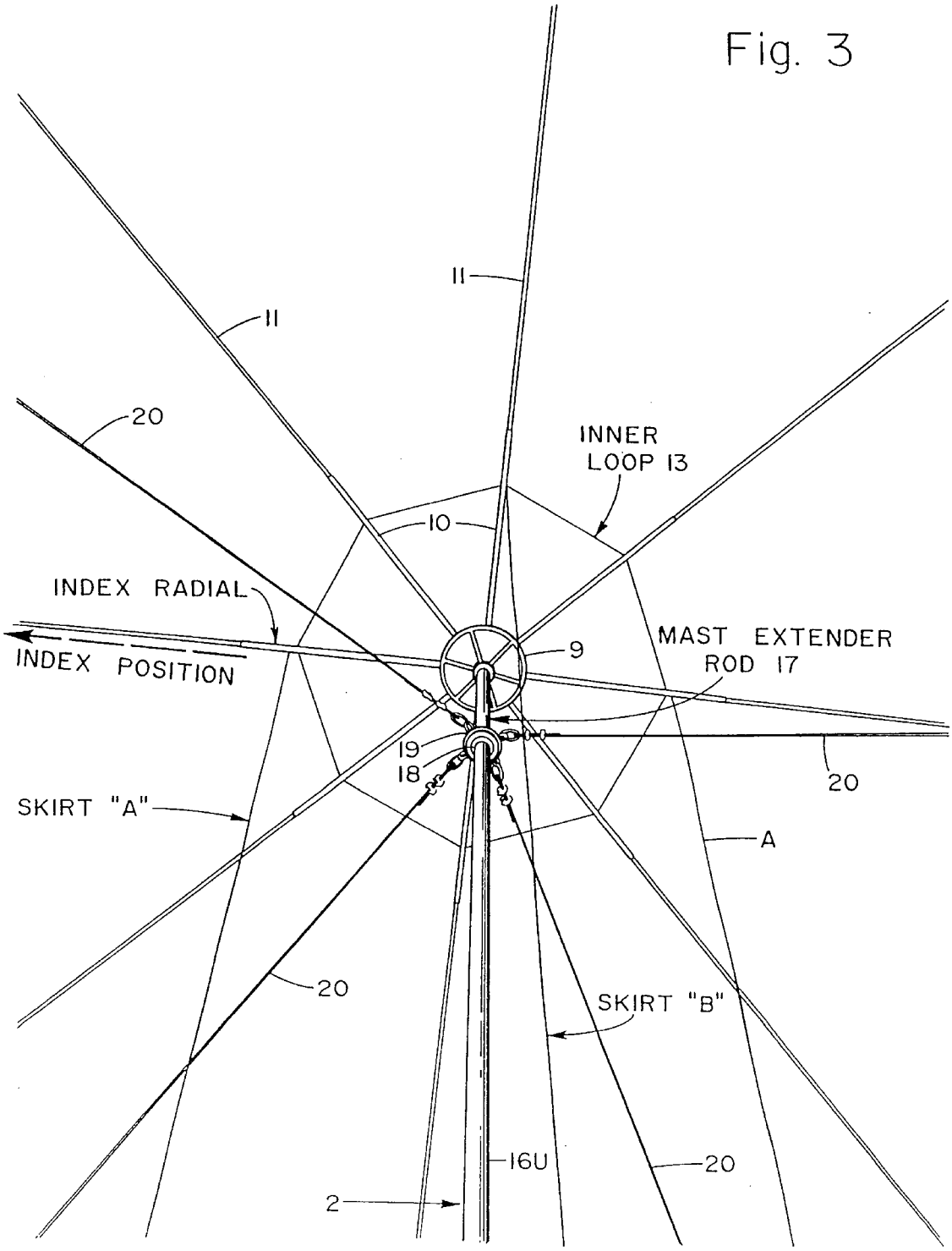
FIG. 3 is a perspective view of the upper portion of the antenna of FIG. 1, but showing additional details of the top hat structure and part of the guy cables for anchoring the mast.
Figure 4:
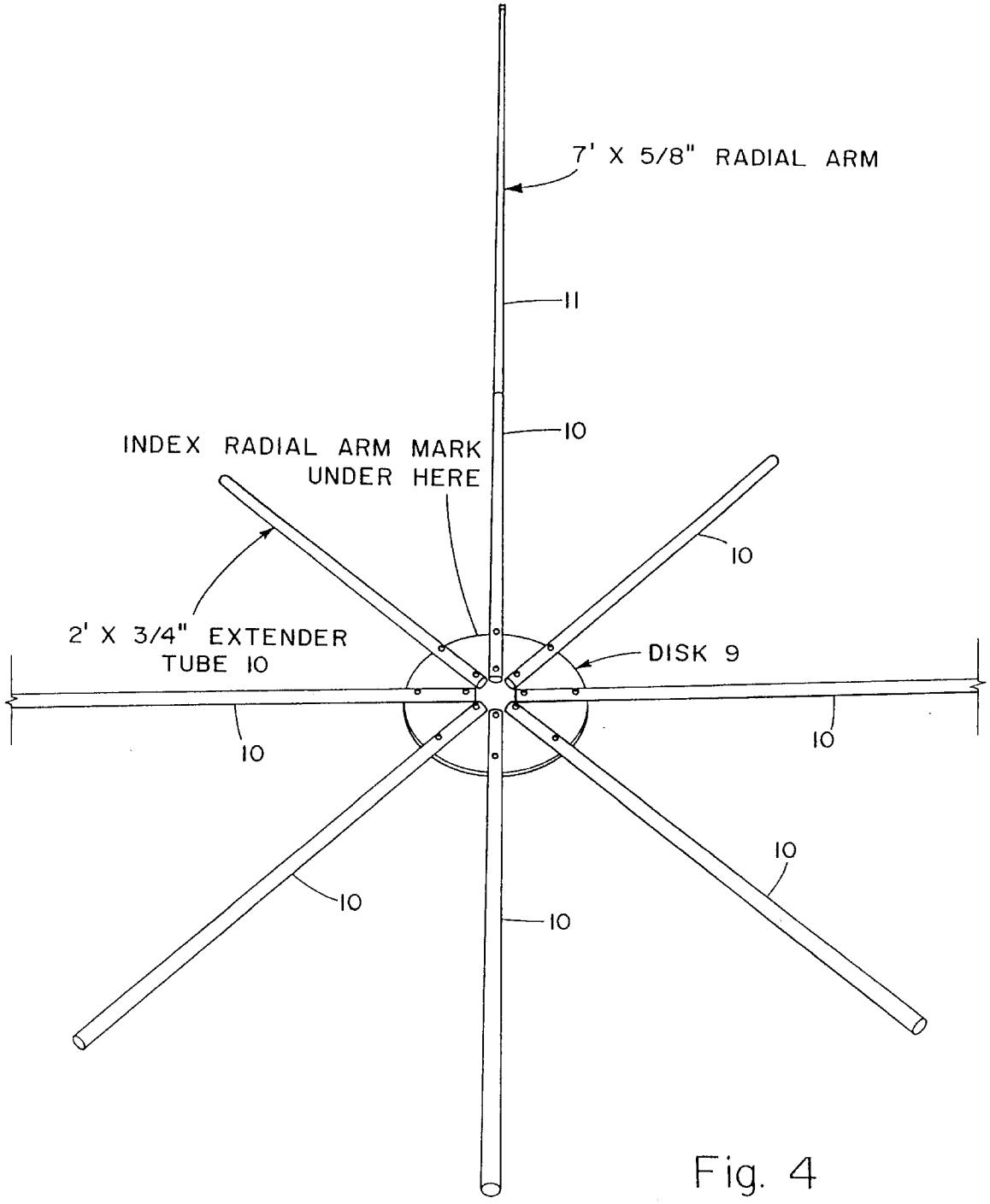
FIG. 4 shows part of the supporting spider used in the top hat.
Figure 5:
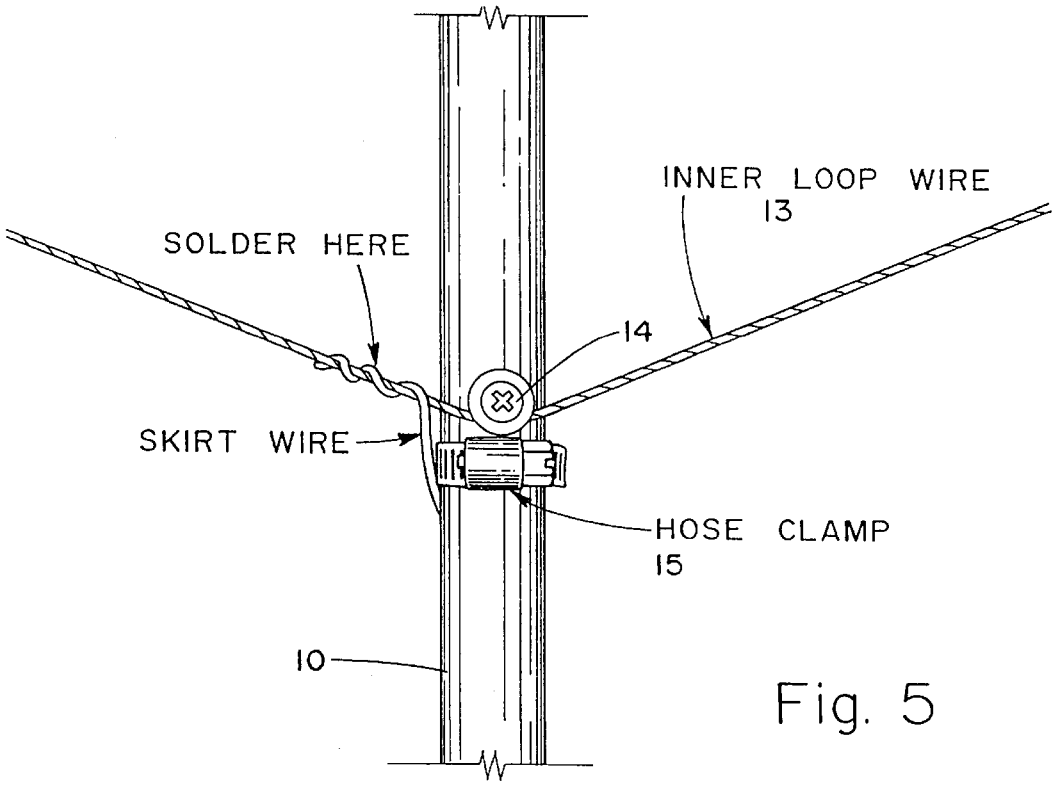
FIGS. 5 and 6 illustrate the connections of the inner loop and outer loop wires to respective arm portions of the top hat spider.
Figure 6:
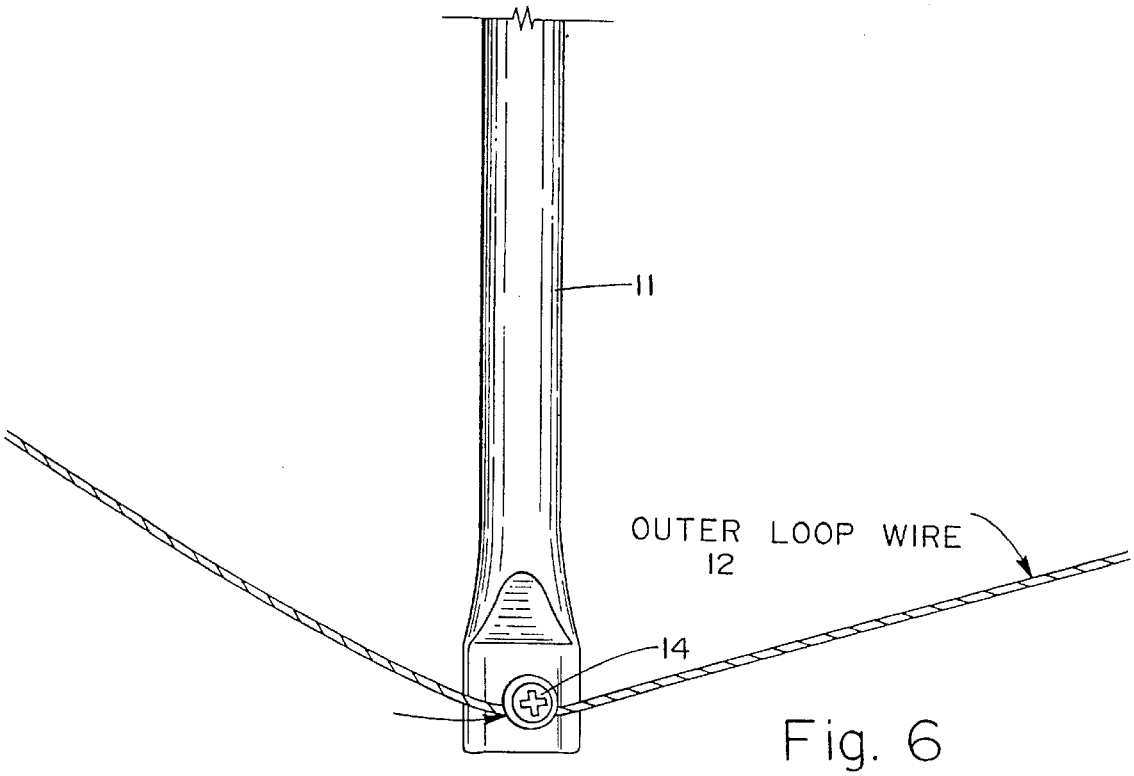

FIG. 3 shows the principal components of the upper end of the antenna system as seen from beneath the top hat 3 and just to one side of the mast 2. The main supporting structure of the top hat 3 spider configuration comprises an aluminum disc member 9 having a cast aluminum hub socket portion on its under side into which the upper end of a mast extension 17 snugly fits to keep the disc securely oriented in a horizontal plane perpendicular to the mast. Secured to the top surface of the disc 9 and radially oriented relative to the mast are a plurality of eight horizontally essentially coplanar uniformly spaced 2 foot long ¾ inch OD aluminum extender tubes 10. Telescopically coaxially received in the outer ends of the extender tubes 10 and secured by screws are respective 7 foot long ⅝ inch OD aluminum arms 11 also radially oriented relative to the mast 2. An octagonal 17 foot diameter outer wire top hat loop 12 seen in FIG. 1 interconnects the outer ends of the arms 11 in the manner detailed in FIG. 6 at points located about 8½ feet from the mast axis. An octagonal inner wire top hat loop 13 is connected to each of the extender tubes 10 at a distance of 19 inches from the mast. This distance corresponds to the distance of each of the vertical skirt wires A and B from the mast. The radius or spacing of the skirt wires A and B from the center mast 2 is critical to the design of the antenna system. The 19 inch optimum spacing for the described ratio of the mast diameter to skirt wire size was determined through experimentation. The top hat dimensions of 17 feet (the diameter of outer loop 12) was determined from the need to add approximately 200 pf of capacitance or 9/18 degrees of electrical length to the antenna system. This capacitance added to the antenna system eliminates the need for additional vertical physical height as would otherwise be required for a quarter wave length (90 degree) vertical antenna.

The wires of loops 12 and 13 have their ends twisted and soldered together and are fastened to the radially extending spider portions 10 and 11 of the top hat 3 by means of small machine screws 14 with washers which are threaded into conventional threaded nut-serts permanently anchored in the extender tubes 10 and radial arms 11. At a point adjacent the inner loop wire 13 on each of four alternate extender tubes 10 the upper ends of respective skirt wires A and B are mechanically and electrically secured by means of hose clamps 15 at a distance of 19 inches from the mast. An end portion of each skirt wire is also wrapped around and soldered to the inner loop wire 13 to assure optimum conductivity between the skirt wire and the loop 13.

Figures 20, 21:
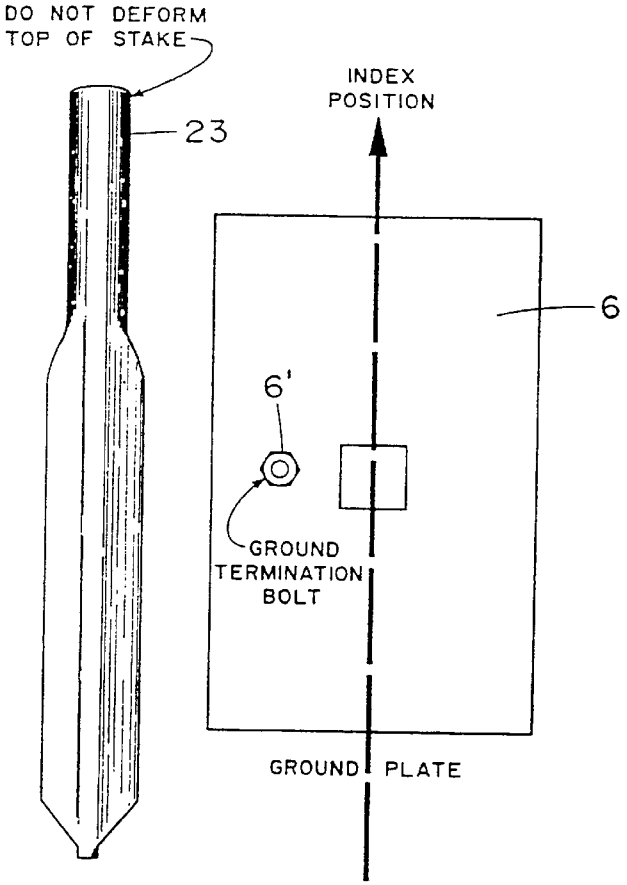
FIG. 20 illustrates a ground stake which locates the bottom end of antenna mast structure which fits thereover.
FIG. 21 illustrates an electrically conducting ground plate which fits around the stake of FIG. 20 beneath the antenna mast structure and provides a common connecting point to connect several antenna components to ground.

Only the upper tubular section 16U of three telescoping 10 foot tubular sections of mast 2 is seen in FIG. 3. These three sections, labeled 16L, 16M and 16U for lower, middle and upper in FIG. 1, are each 10 feet long and from bottom to top have respective outside diameters of 1¾, 1½ and 1¼ inches with inside diameters enabling them to be manually slid with a close fit one within another during assembly. A fourth mast section in the form of a shorter vertically extending tubular or rod member extension 17 is secured to and clamped within the upper end of mast section 16U by a clamping bolt and nut. The bolt passes through registering and indexing holes in the upper end of the upper mast section and the lower end of the mast extension 17. A collar 18 near the upper end of the upper 10 foot mast section 16U grips this mast section just below the lower end of the inserted extension 17 and provides a support for the uppermost of three guy cable rings 19. Each guy cable ring has a central annular portion closely encircling a respective mast section. The other two guy cable rings encircle the upper ends of the middle 16M and lower 16L mast sections and each is prevented from sliding downwardly on these two mast sections by means of an annular ridge formed on the surface of the respective mast section a short distance below its upper end. Each guy cable anchor ring 19 is provided with means to suitably clamp or secure thereto the upper ends of a set of four electrically insulating guy cables or lines 20 which extend downwardly and outwardly from the anchor ring with their lower ends secured in a well known manner as seen in FIG. 21 by turnbuckles 21 to 3-inch diameter eye loops at the exposed ends of respective conventional auger-type anchors 22 imbedded in the soil and uniformly spaced around and about 17 feet from the base of the mast 2 at the corners of a 25 foot square.

The material for the guy line 20 must be non-metallic for the antenna system to function properly. A recommended line material for the guy installation is 1200 lb. test Phillystrand line comprising plastic coated carbon fibers. Three-sixteenths inch diameter or larger UV treated dacron or nylon rope will suffice in lieu of the higher cost Phillystrand material. However the dacron or nylon rope will not last as long as the Phillystrand material when exposed to direct sun light and other related weather elements and nylon line is more subject to stretching than either the Phillystrand line or Dacron line.

Three guy cables 20 at each of the other corners of the square are similarly secured to an auger-type anchor in the manner shown in FIG. 3. The anchor rings are positioned to provide guy means resisting wind or other external forces on the antenna and supporting the mast 2 against any lateral movement at three equi-spaced points which essentially divide the mast into three approximately 10 foot sections of equal length above the ground. Such support of the mast maintains its symmetry and a constant feed line impedance. Two additional similar clamping collars (not shown) mechanically and electrically connect the other adjacent telescoped ends of the 10 foot mast sections after the sections are telescopically extended to their respective operating positions in an assembly sequence described hereinafter. The insulator assembly 5 adds a total of 15 inches to the height of the mast. The combined length or height of the assembled sections of the mast 2 and the supporting insulator 5 is 31 feet 3 inches.

To assemble the antenna tower, the mast with its three 10 foot section retracted together is attached to the insulator assembly 5 in a manner explained hereinafter and the mast raised to a vertical position with an axial bore in the lower end of the insulator sliding over the upper cylindrical end of a mounting soil stake 23, shown in FIG. 20, and extending from the soil vertically through the center of the ground plate 6 shown in FIG. 21. The lowermost guy ring is then connected by guy cables to hold the lower mast section erect with the other 10 foot mast sections in their lowest telescoped positions, these telescoped sections extending only 12 feet 3 inches above the ground so that their upper ends are readily accessible with an eight foot step-ladder. After assembly of the top hat structure 3 with its supporting spider, wire loops 12 and 13 and upper ends of skirt wires A and B secured on the disc 9, the socket on the under side of the disc 9 is secured rigidly to the upper end of the mast extender tube 17 by suitable bolting means to form a good mechanical and electrical connection therebetween. A good electrical connection is essential because the maximum RF antenna current occurs at this location. The extender tube 17 and top hat 3 are then raised to allow this assembly to be mounted with the lower end of the tube 17 extending into the upper 10 foot mast section 16U. Transverse aligning holes in the tube 17 and this mast section 16U allow their relative axial and rotational positions to be fixed by insertion of a conventional removable locking retaining pin (not shown) through these holes when they are in registry. Thereafter these tubular mast parts 17 and 16U are secured together mechanically and electrically by suitable bolting means as stated above.

After mounting the top hat assembly and mast section 17 on the upper mast section 16U, the upper mast section 16U is raised within the middle section 16M, with the guy cables trailing from the ring 19, until similar transverse aligning holes near the ends of upper and middle mast sections 16U and 16M are in registry and another locking pin is then inserted through the aligned holes. The lower ends of skirt wires A and B are left hanging from the top hat for connection as described later until the mast with top hat in place is completely assembled. Short telescoped end portions of the upper and middle mast sections are then clamped together by means of a clamping collar for good mechanical and electrical connection therebetween. Thereafter the middle mast section 16M is raised within the lower mast section 16L, with the guy cables from its guy ring trailing downwardly, until a third set of similar transverse aligning holes in the middle and lower mast sections are in registry and another locking pin is then inserted therethrough. Telescoped end portions of the middle and lower mast sections are then also clamped together by means of a clamping collar for good mechanical and electrical connection therebetween. After raising and clamping the tube 17 and the upper and middle mast sections as just described, the upper two sets of guy cables 20 are extended to and secured at the four auger-type ground anchors 22 with suitable adjustment of the turnbuckles 21 to keep the entire length of mast 2 anchored in a straight and vertical position.

The insulating support assembly 5 is shown in FIGS. 11–12 and comprises a two-part insulating member with a coil form portion 38 supported by an elongated vertically extending cylindrical central insulating body portion 30 of the same 1¾ inch diameter as the lowermost mast section 16L. The insulator body 30 and coil form 38 are made of CPVC material with UV dye blockers impregnated for protection from direct sunlight.

The upper end of the body portion 30 has a slightly reduced diameter to fit snugly within the lower end portion of the tubular lowermost mast section 16L with the end this tubular mast section bearing against a shoulder 31 at the lower end of the reduced part of the body 30. The lower end 32 of the body 30 is provided with a cylindrical coaxial bore shown in dotted lines in FIGS. 11–12 to receive the upper cylindrical end of a stake seen in FIG. 15 which fits closely through the central opening of the ground plate 6 seen in FIGS. 1, 7–10 and 16. After the stake is driven into the ground and the plate 6 slipped thereover, the lower end 32 of the insulating support is fitted over the exposed end of the stake and bears against the plate 6 in the course of mast assembly as described above. The shoulder 31 is 15 inches above the ground plate 6.

In an upper portion of the body 30 below the shoulder 31 is a horizontally extending transverse bore 33 normal to the axis of the mast 2 and through which extends part of the tensioning spreader means S for the lower ends of the skirt wires A. This tensioning spreader means comprises a horizontal aluminum spreader tube member 34 extending through bore 33 and having opposite ends extending horizontally equi-distant on opposite sides of the body 30 with the lower ends of the skirt wires kept in electrical contact with the tube 34 and held in tension at a distance of 19 inches from the mast 2 by means of hose clamps around the wires A and the ends of tube 34.

Between the transverse bore 33 and the shoulder 31 is another horizontal transverse bore 35, oriented 90° from bore 33, and through which extends another part of the tensioning spreader means S for the lower ends of the skirt wires B. This tensioning spreader means comprises a horizontal aluminum spreader tube member 36 in bore 35 and associated hose clamps which function like tube 34 to tensionally hold the lower ends of skirt wires B at a distance of 19 inches from the mast 2. The tube members 34 and 36 have their central portions fixed within the body by screws and the tubes are sufficiently springy so that they may be slightly bowed during clamping of the skirt wires to maintain the skirt wires in tension to keep them straight during operation of the antenna.

After the lower ends of the skirt wires A and B are connected to the spreaders 34 and 36 as described above, the free ends need not be trimmed because retaining them may help in working with the wires if the antenna needs to be disassembled and reassembled.

About midway along the exposed portion of the vertically extending insulating body 30 is a cylindrical insulating coil form 38 of the same material as the body 30 and integral with or bonded to the body 30. The coil form 38 is coaxial with the insulating body 30 and may be manufactured as a separate cylindrical member slidable on the body 30 and adhesively secured to a central portion of the exposed surface of body 30. The coil form 38 has a winding surface 3 inches in diameter with a continuous winding groove in which is wound an inductive impedance transforming coil winding 40 of #14 copper wire which is connected in series between the mast 2 and ground. As seen in FIG. 11, the lower face of coil form 38 has a small bore containing a vertically adjustable ferrite rod or slug 39 extending upwardly within the coil 40 to tune the coil in a manner described later. The ⅜ inch diameter and 2 inch long slug 39 is held in an adjusted position by a screw 39'. The winding 40 in has its first or lower end extending through the coil form for connection to an external terminal 41 at the bottom of the form. Terminal 41 is in turn connected to the outer conductor of a first conventional female coaxial cable connector 42 having a horizontal axis and its base fastened to the body 30 below the coil form by several screws. A grounding wire 43 extends from this outer conductor with its lower end held in place by a hose clamp 44 near the lower end 32 of the body 30. The lower free end of the grounding wire will be connected to the terminal post 6' on the grounding plate 6.

The upper or second end of the coil winding 40 extends through the coil form to a terminal 45 on the upper surface of the coil form. A tap or intermediate point on the coil winding 40 passes through the coil form to a another terminal 47 on the upper surface of the coil form. Conducting wires 46 and 48 extend upwardly from terminals 45 and 47 and provide means for selectively switching the connection of one terminal or the other directly to the mast 2 in a manner described hereinafter. The inductance of the complete coil winding 40 is about 6.5 microhenries and the tapped portion is about 75 percent of this value. Other switching means (not shown) could be used to remotely select connection of wire 46 or wire 48 to the mast to change or vary the amount of the inductance winding 40 between the mast and ground.

The coil 40 is designed to enable matching of the antenna system to the feed line input on two principal upper and lower frequency band portions of operation within the 160 meter band and provide for a means of changing resonance. The coil 40 has essentially no effect on operation in the 40 and 80 meter bands. It has been found that this coil needs to be of large 3 inch diameter to achieve the desired operation. The coil 40 works in concert with two coupling capacitors 61 and 62 for skirts A and B, respectively, as described hereinafter to resonate the antenna system on 160 meters and to perform a match to the 50 ohm impedance necessary for 50 ohm transmission lines from today's solid state transceivers. The input capacitors 61 and 62 are manufactured from military grade RG-213 coaxial cable. The antenna utilizes the capacitance characteristics of the coaxial cable to its advantage. RG-213 cable exhibits a capacitance value of 2.49 pf per inch of cable (typically). On the 160 and 80 meter bands of operation this equates to roughly 100 inches of cable required for coupling the feed line to the antenna. RG-213 cable is relatively inexpensive compared to packaged high voltage and high current variable capacitors and their weather tight enclosures which could otherwise be used in lieu of capacitors 61 and 62.

The center female conductor 49 (FIG. 11) of connector 42 is connected by a wire extending transversely through the body 30 to a corresponding center female conductor of a second conventional female coaxial cable connector 50 with its base fastened by screws on the side of the body 30 opposite from connector 42 with these connectors 42 and 50 being coaxial. A bypass wire 51 extends from the base and outer conductor of connector 50 in spaced relationship around the coil winding 40 and extends to the base and outer conductor of a third similar female coaxial cable connector 52. It is essential that the bypass wire 51 be located to the outside of the coil 40 and spaced at least ¾ inch therefrom to assure no coupling therebetween to enable desired resonance and impedance matching results to be achieved. The connector 52 is similarly fastened to the body above the coil form with its axis horizontal. The base of connector 52 has a short flexible free-end wire 53 connected thereto and extending parallel to the bore 33 for electrical connection via a hose clamp to the spreader tube 34 and therethrough to the lower ends of skirt wires A as described later. The center conductor of connector 52 has a flexible free-end wire 55 connected thereto which passes through the body 30 and exits the body at the opposite side with its end extending parallel to the bore 35 for electrical connection via a hose clamp to the spreader tube 36 and therethrough to the lower ends of skirt wires B as described later.

The insulator assembly 5 takes advantage of the symmetry of the skirt system. The S0–239 connectors 50 and 52 where the coaxial capacitors terminate are in line with the low band skirt spreader 34 for skirt wires A. Each coaxial capacitor outer shield conductor is at the same RF potential as the low band skirt spreader, so each capacitor is physically tied to and has a first portion supported by this spreader and then has a further portion run vertically up along one skirt A wire to tie them off so they will not couple with any other antenna electrical components. This makes for a very neat and practical method of packaging the critical impedance matching components of the antenna. This is a very important design aspect of the antenna insulator assembly.

Figure 7:
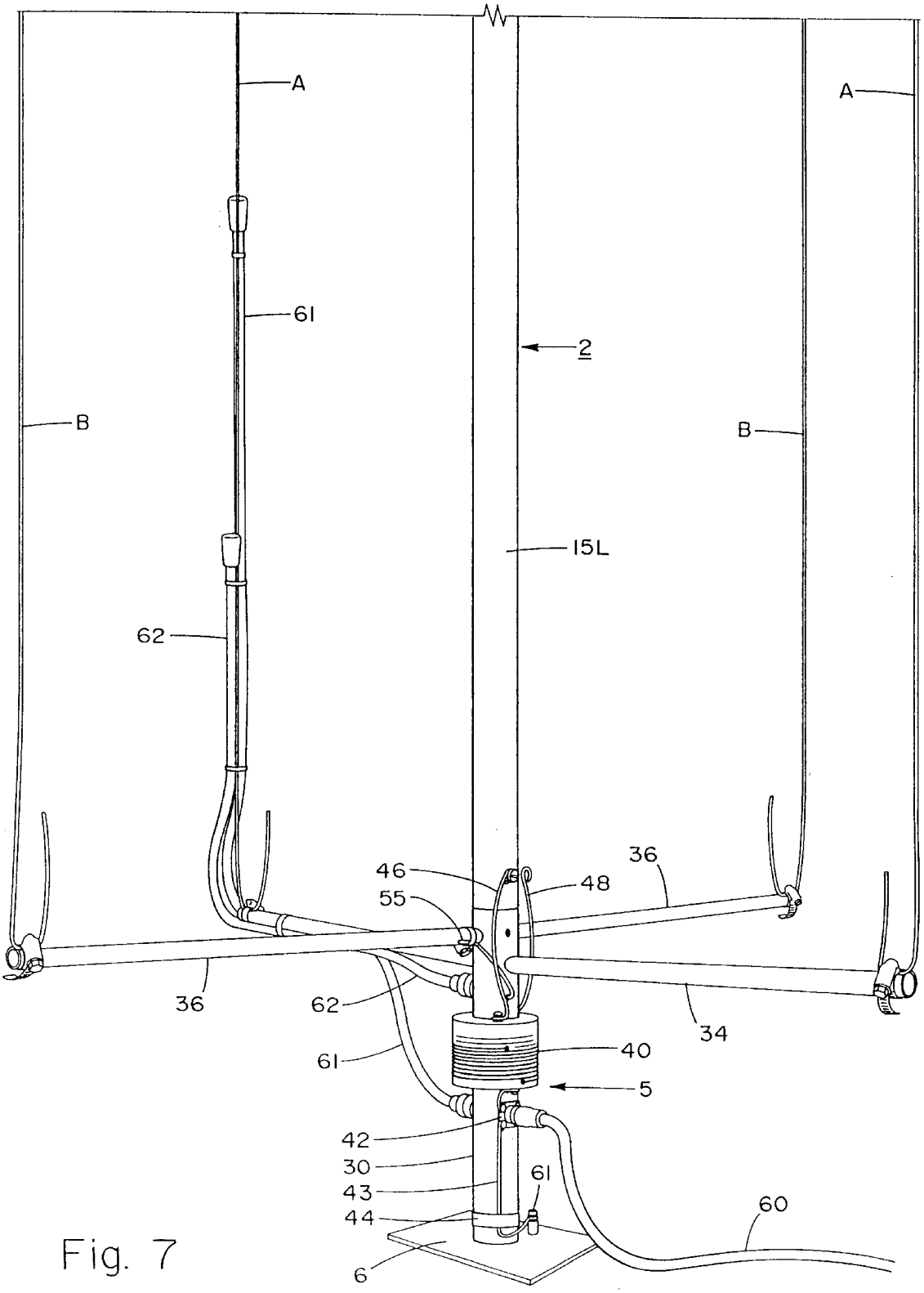
FIGS. 7–10 are perspective views from slightly different angles of the base portion of the antenna showing the manner in which an input-output cable is connected to the antenna and showing details of a impedance transforming coil structure between the mast and ground and also showing two coaxial cable capacitors connected to couple energy between the input-output cable and the bottom ends of the skirt wires.

When the antenna assembly is completed, the lower portion of the assembly near the ground will appear as in FIGS. 7–10. Therein the lowermost section 16L of the mast 2 is supported by the insulating structure 5 which has features shown and described above in connection with FIGS. 11–12. FIGS. 7–8 show an input/output 50 ohm coaxial feed cable 60 having one end connected to the coaxial connector 42. The other end of cable 60 is connected to suitable conventional tunable transmit/receive apparatus preferably with a 50 ohm output impedance (not shown).

Signals are coupled between the feed cable and the spreader tube 34 for skirt wires A by means of the coaxial cable capacitor 61. This capacitor 61 is an open-ended coaxial RG-213 line having at one end a male coaxial PL-259 connector threaded on the connector 50. The inner conductor of the coaxial line capacitor 61 is connected to the mutually connected inner conductors of the connectors 42 and 50. The outer conductor of capacitor 61 is connected to the outer conductor of the connector 50 and therefrom via wires 51 and 53 to the spreader tube 34 to which the wire 53 is clamped by a hose clamp. The capacity of the capacitor 61 can be made progressively less by cutting off incremental lengths of the free end of the line, making sure that the inner and outer conductors are not shorted together after a portion is cut off.

Another similar, but shorter, open-ended coaxial line coupling capacitor 62 is connected to the coaxial connector 52 to provide a capacitive connection between the outer conductor of connector 52 and the center conductor thereof which is connected to the wire 55. As seen in FIGS. 7–8, the wire 55 is connected by a hose clamp near the insulating body 30 to the spreader tube 36 which tensionally supports the lower ends of the skirt wires B. This coaxial capacitor may also be progressively shortened for purposes described later.

After a desired value of capacity is achieved for each of the capacitors 61 and 62 by trimming their lengths for purposes described later, the conductors at the open end portions of the lines are carefully separated by pulling the braid of the outer conductor back a short distance without disturbing the dielectric insulation to assure electrical separation of the conductors which are then potted by means of a suitable insulating silicon sealant in small insulating cups 64 to protect the ends of the conductors and the line dielectric from moisture or any other any hostile environmental condition.

The skirt wires are terminated to the capacitive top hat at the same radius as at the spreaders below. This configuration provides the means by which impedance transformation takes place. Skirt wires A mutually couple with skirt wires B on the low band (160 meters) design frequency range needing only the single coupling capacitor 61 connected from the coaxial feed line center conductor to the spreader for skirt wires A. On the second harmonic frequency band (80 meters), the other series capacitor 62 is inserted between spreaders 34 and 36 for the sets of skirt wires A and B, respectively, for effectively coupling or making visible or effective the skirt wires B and providing that both of the sets of skirt wires A and B are radiators. Disconnection of capacitor 62 has minimal effect when operating within the 160 meter band. Capacitor 62 couples skirt B and skirt A on the second harmonic frequency allowing for resonance and impedance matching.

It is believed that the top hat capacitance section 3 coupling to the surrounding earth ground and radial system forces the skirt wires of the system to radiate, hence the reference to the antenna system as a short feed radiator. The folded skirt wires of the antenna system combined with the top hat provide the efficiencies and high current distribution within the short physical structure. The relative wide band width of 50 or 87 kHz is attributed to the 38 inch diameter of the skirt system and its interaction with the top hat. Evidence of this interaction is apparent when the inner loop 13 at the termination of the skirt wires to the top hat is left off. Then the band width reduces and narrows to about 30% of the bandwidth referred to above when the inner loop 13 is in place. Also, the ability to obtain a good resistive impedance match to the feed system diminishes without the inner loop 13. The top hat interface to the mast aids in providing a current transfer from the skirt wires to the mast shunt point on both 160 and 80 meter bands, eliminating the need for any shorting connections between the skirt wires and the mast as found in prior unipole designs.

The present antenna system utilizes the skirt system as a impedance matching device, feed system, and low loss radiator. The capacitive top hat further lengthens the structure electrically and contributes to the shape of the RF pattern emitted. It has been determined (using a relative field strength meter which provided a pulsating visual signal with a pulsing frequency that was dependent on antenna currents at different heights) that the maximum field generated by the present vertical antenna system is roughly twenty feet above the ground level. Field currents have been found to be varying in strength from the ground up and in combination with the top hat are believed to contribute to the flattened cylindrical shape of the RF field emitted. The inverted or top down current field, maximum at top to minimum at the base, is inverse from the typical vertical radiator. This inverted current field is believed to contribute to the net gain in energy radiated by the antenna system in a manner not fully understood. The top down current distribution produces an RF field higher up the structure thus launching the emitted field from 20 feet above the ground instead of at ground level. With such a top emitting antenna, there are less effects of nearby ground level objects to distort the emitted RF field. The top down field distribution attributes to the success of the short radiator antenna system in a typical suburban lot location. A high number of successful two way contacts over essentially the entire continental United States while running low power (100 Watts) on 160 meters at Dallas, Tex., during experimental operation of the antenna system affirms this finding.

It is believed that the basic concepts of the present antenna system are similarly applicable to a horizontal antenna system with appropriate modification to replace the top hat with a substitute capacitive system, interacting with the horizontal support (replacing the mast) and the skirt wires, located at the end of the antenna remote from the skirt feed.

Also the size of the present system lends it to use in portable mobile antenna systems with a metal vehicle body functioning as a ground plane. Moreover, the system lends itself to maximum portability and easy assembly and disassembly in a minimum of time.

Further uses of the present invention include using a plurality of such vertical radiators in a geometric pattern with the individual radiators relatively phased from a common feed point to provide gain and directivity using known concepts to achieve directivity as in existing vertical antenna systems.

An optional addition for the present antenna system achieves operation on still another lower wavelength higher frequency band such as the 40 meter amateur band. This is achieved by means of a series trap assembly T shown in FIG. 14 and comprising an inductance means 70 and a coaxial cable capacitive means 71 connected in series between the mast 2 and a skirt wire A. The trap capacitor 71 and inductance 70 achieve an effective impedance match and resonating condition in the 40 meter band without affecting operation on either the 160 or 80 meter bands. The trap is located about 25 percent of the antenna height above the ground plate 6. The inductance means 70 includes a coil 72 wound on a coil form portion 73 on an elongated cylindrical insulating body 74. The coil form 73 and body 74 correspond in diameters and materials to the insulating body 30 and coil form 38 of the base insulating assembly 5. The axis of the cylindrical body 74 is oriented perpendicularly to the mast 2 with one end of the body being provided with mounting means to clamp it to the mast by a pair of metal hose clamps 75. One end of the coil 72 is connected to a wire 76 which extends through a transverse hole in the body 74 parallel to and near the mast. The wire 76 is electrically clamped to the metal mast 2 by hose clamps 75. At the other end of the body 74 is a female coaxial cable connector 77 having its inner conductor connected to the other end of the coil 72 by a wire within the body 74. The base of the connector 77 is securely screwed to the end of body 74 with one of the screws providing an anchor and electrical connection from the base and outer conductor of the connector 77 to a one end of a stiff wire or rod 79, such as brass welding rod, extending to a skirt wire A and having a short end portion which is bent at a right angle to extend along the skirt wire A and is connected thereto by a wire clamp fastener 80. The coaxial cable capacitor 71 has a male connector threaded on connector 77 and extends radially with respect to the mast along the wire 79 to which is mechanically secured by a plurality of plastic ties. The capacitor 71, like capacitors 61 and 62, is made from a section of coaxial line or cable. Capacitor 71 has a capacity of about 27 pf. and is about 10.8 inches long. After the length of capacitor 71 is trimmed to obtain the needed capacity, the free trimmed end is sealed for protection in an insulating cup 64 like those used for capacitors 61 and 62. The coil 72 has an inductance of about 6.5 microhenries. The clamps 75 and 80 are manually releasable to allow the position of the series trap T to be adjusted up or down along the mast and skirt wire A to tune the antenna for operation in the 40 meter band.

Although the trap T is connected from the mast 2 to only the skirt wire of set A which is opposite to the skirt wire along which the capacitors 61 and 62 extend, there is a mutual interaction among the four skirt wires when operating on 40 meters. It is believed that the portions of the skirt wires above the physical position of the trap T are mutually coupled when operating on 40 meters. Traps similar to trap T may be used in lieu of or in addition to trap T for other bands of operation. For example a trap for 30 meters (10.1–10.15 MHz) may be used at a height slightly lower than trap T. It is believed that such a trap could also provide efficient operation on 15 meters (21–21.45 MHz) and 10 meters (28–29.7 MHz) because of the harmonic relationships.

Figure 13:
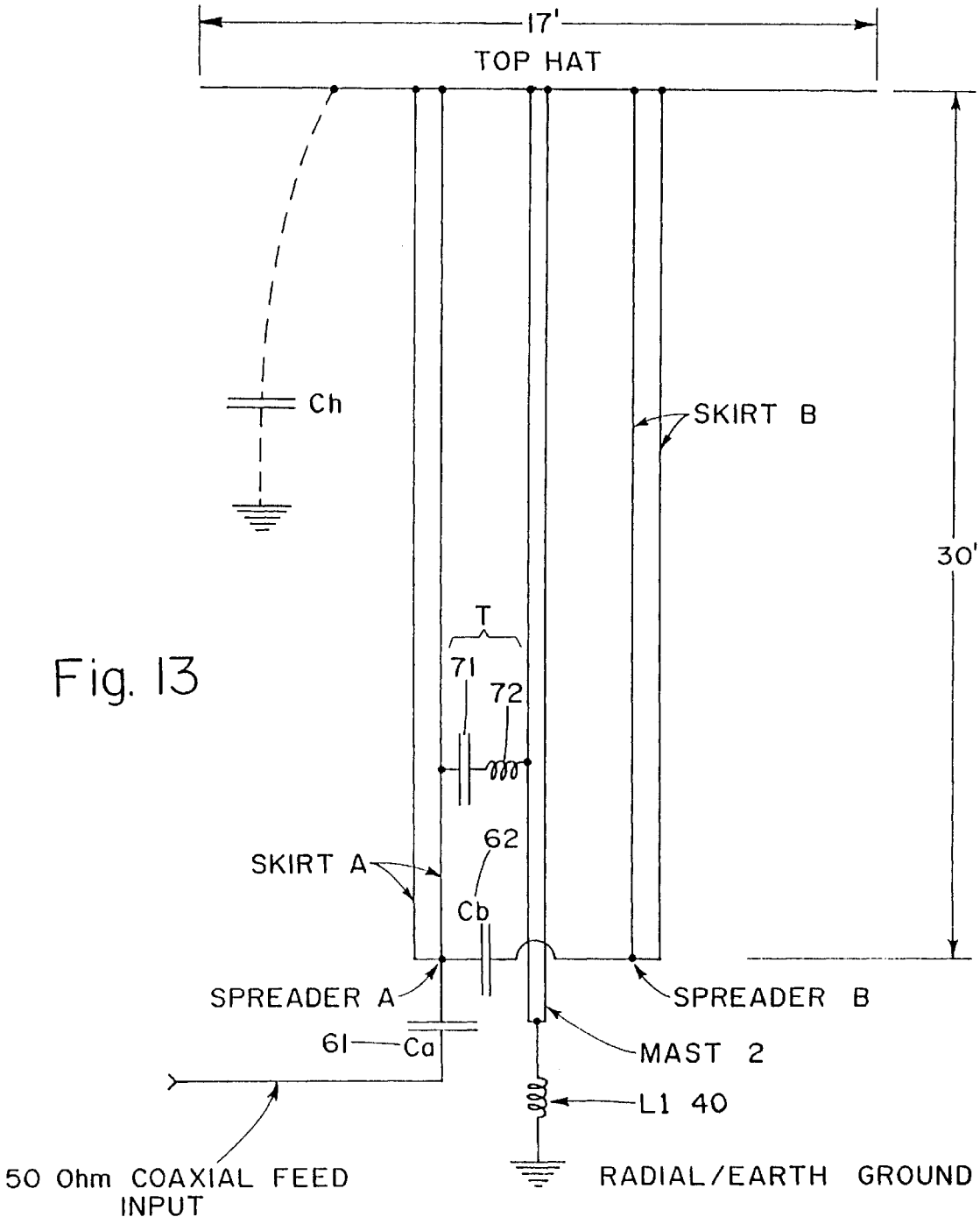
FIG. 13 is a schematic/diagrammatic representation of the electrical components of the antenna system of FIGS. 1–12, but with the addition of a series LC shunt representing the structure of FIG. 14 connected between the mast and one skirt wire.
Figure 14:
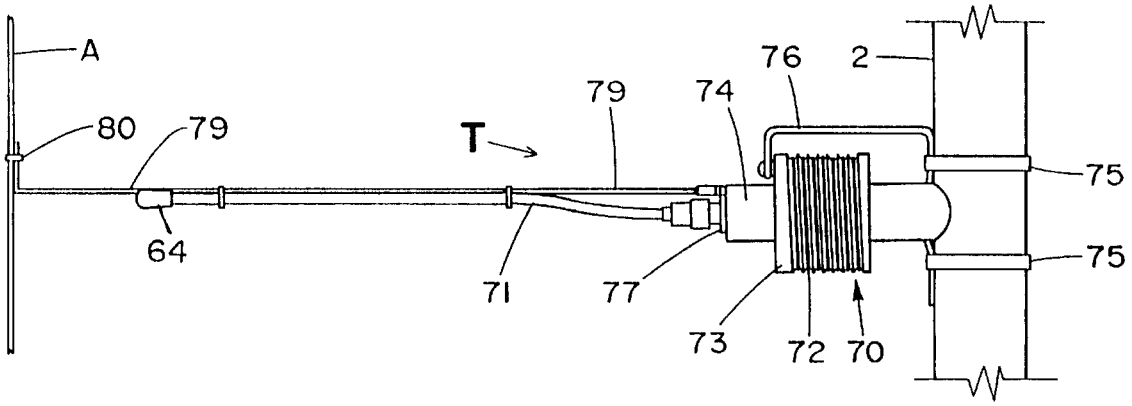
FIG. 14 illustrates a coil structure anchored to the antenna mast with a wire extending to one skirt wire and supporting a coaxial cable capacitor electrically in series with the coil between the mast and the skirt wire.

This trap T of FIGS. 13–14 provides a means by which capacitive reactance of the antenna at the input can be counteracted by the addition of inductive reactance to achieve zero reactance and provide an impedance at the antenna input which approximates a pure resistance for matching to the 50 ohm feed cable for 40 meter operation. Another embodiment describe later in connection with a skirt system C in FIG. 32 also achieves near zero reactance on 40 meters in a similar fashion, FIG. 13 illustrates schematically the relationship of the interconnections of the various antenna components including the addition of a series LC shunt 72-71 representing the structure of FIG. 14 connected between the mast and one skirt wire A. In addition, the capacitance Ch represents the capacity of the top hat relative to ground.

Figure 15:
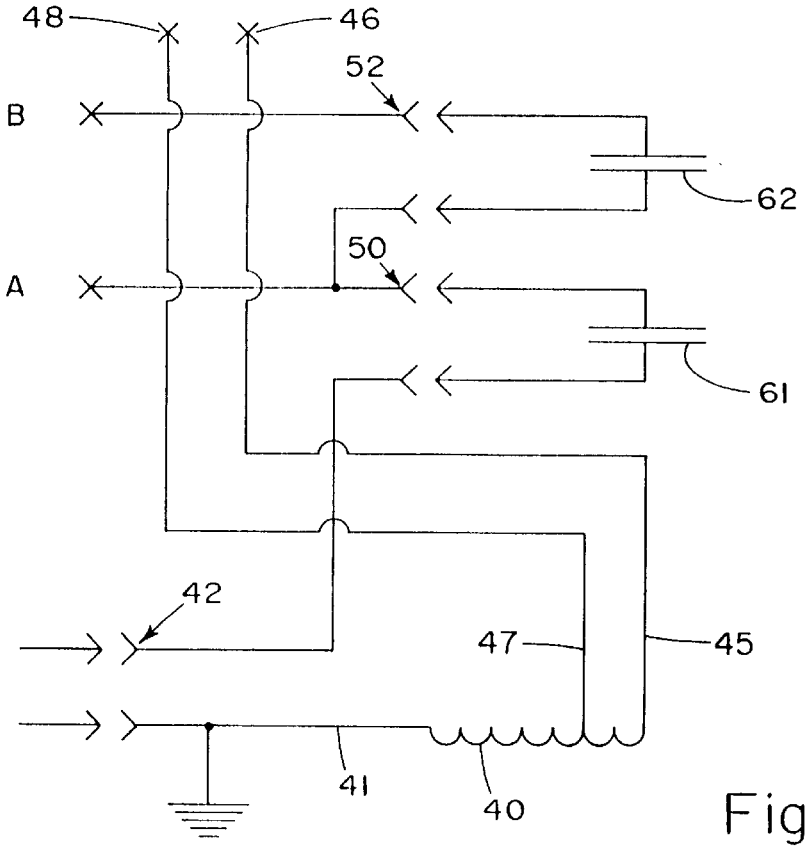
FIG. 15 is a partial schematic of the electrical components on the coil structure at the base of the antenna and showing the coaxial cable connections.

FIG. 15 illustrates the several electrical connections of antenna components which are made in FIGS. 7–10 on the insulating mast support structure of FIGS. 11–12.

Since several of the antenna components must be assembled with particular orientations, the ground plate 6 (FIG. 21) and other components may be marked with position indices to assist in locating components in their correct relative positions during assembly.

Tuning Setup Procedures

The tuning procedures require multiple steps of pruning the various coaxial cable capacitors to vary their capacity. During such pruning it is important to make sure the braid and center conductor are not touching or in contact with each other. The braid is spread away from the center conductor after each pruning to prevent a short. If the coaxial capacitor is shorted a high VSWR condition will be experienced with power applied.

First determine where in the 160 meter band operation is desired. For example, the CW portion of the band is between 1.800 and 1.840 MHz. Most SSB operation occurs between 1.830 and 1.997 MHz. If selection of a low portion of this band is preferable, the low band portion tap wire 46 from coil 40 may be connected to the mast for most or all of 160 meter operation. The two tap wire 46 and 47 are not to be connected to the mast at the same time because the antenna will not tune properly if both are connected.

Next select the center frequency of the band portion of interest in the low end of 160 meters. Add 50–60 kHz to the center frequency and use this frequency to tune for best VSWR for the first cut/pruning of capacitor 61 feeding skirt wires A. However, before cutting or pruning capacitor 61, remove the tuning slug 39 in coil 40 and disconnect capacitor 62 from coax connector 52 and replace it with a shorting connection made with a PL-259 connector which has a jumper soldered between the center pin and the outer connector jacket.

Apply RF power from an exciter or bridge to the antenna and prune capacitor 61 until the VSWR is as close to 1.0:1.0 as possible. Initially prune 1 inch lengths until within 2.0:1 VSWR. Then cut ½ inch lengths until the best VSWR is achieved (typically better than 1.5:1).

Then insert the tuning slug 39 into coil 40 and retune to the original selected center operating frequency. Apply RF to the antenna and move the tuning slug in until obtaining the best VSWR for the frequency of operation. Tighten the slug set screw 39' firmly. The antenna is now tuned initially for 160 meter low band portion operation.

Next, remove the PL-259 shorting connector from coax connector 52 and reconnect capacitor 62. Retune the exciter to the desired operating frequency in the 80 meter band. prune capacitor 62 for best VSWR on 80 meters, first trimming 1 inch increments until reaching the 2.0:1 VSWR point and then ½ inch increments thereafter until reaching best VSWR on 80 meters.

Go back to the 160 meter operating frequency and retune the slug in coil 40 for best VSWR on 160 meters. The antenna is now tuned for the desired frequencies on 160 and 80 meters for the selection of low band portion jumper 46.

After a tuning sequence as just described, the areas of operation in the 160 and 80 meter bands can be shifted merely by connecting coil tap wire 48 to the mast in lieu of wire 46, thus effectively reducing the amount of inductance of coil 40 which is being used.

The above procedure could be varied and essentially duplicated by starting with a selection of a frequency such as 1.999 MHz in a higher portion of the 160 meter band and initially connecting the tap wire 48 to the mast and again trimming the capacitors following a similar procedure.

When redoing the tuning procedure, it is recommended not to adding additional lengths of cable due to the possibility of moisture induced failure of the capacitors at the joints of the extensions. Besides, coax is relative inexpensive to purchase and only a few feet are used for the capacitors.

The present antenna has been developed primarily for use on 160 and 80 meters. However it is found to load equally well on 17 meters which is the 10th harmonic of 160 meters. The antenna is flat across the entire 17 meter band and as a result this band is included in the specification data.

Figure 16:
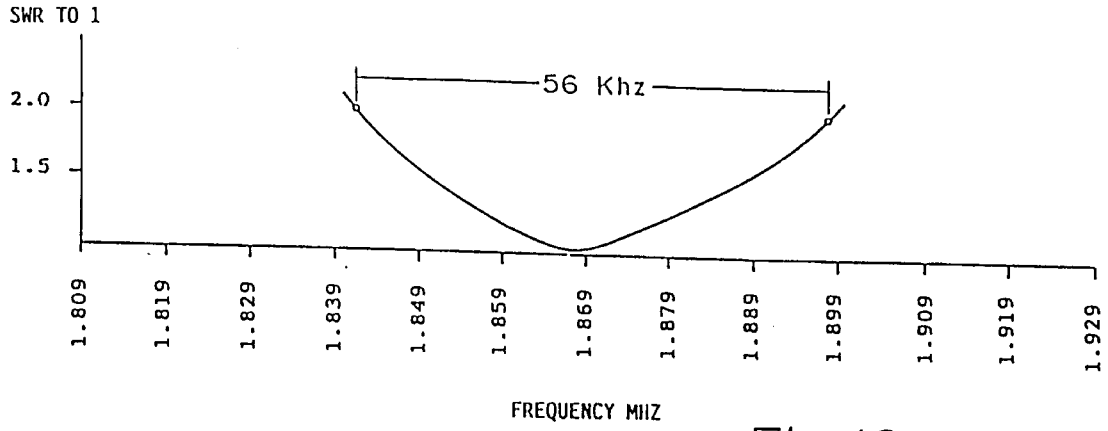
FIGS. 16–18 are plots of standing wave ratios versus frequency for operation of the antenna system over portions of 160 meter and 80 meter amateur radio bands.
Figure 17:
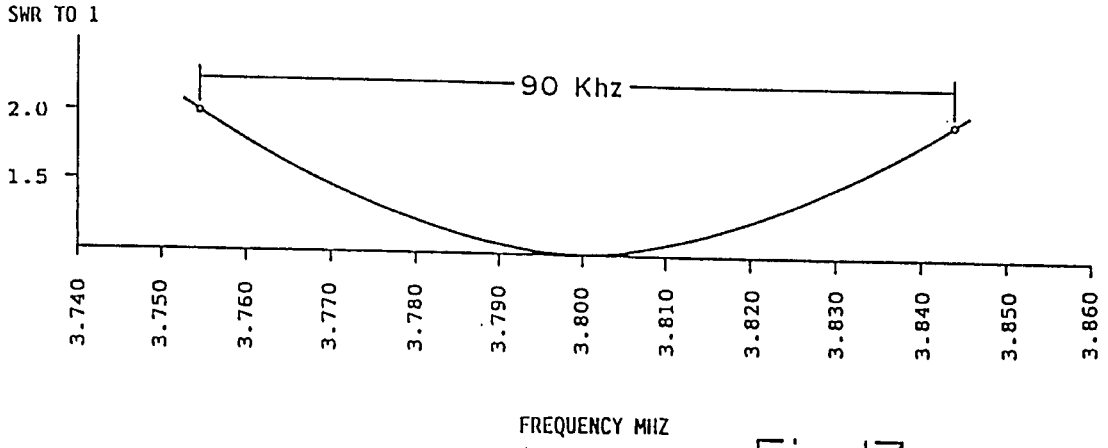
Figure 18:
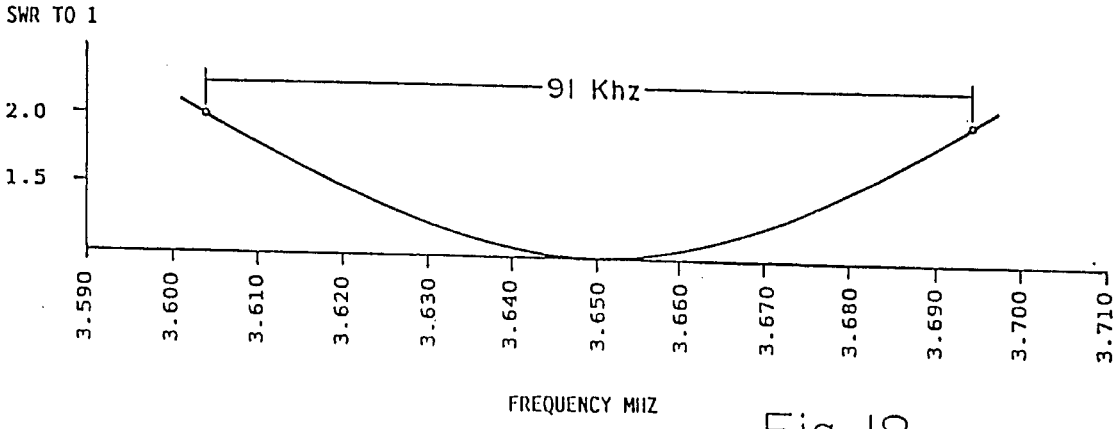
Figure 19:
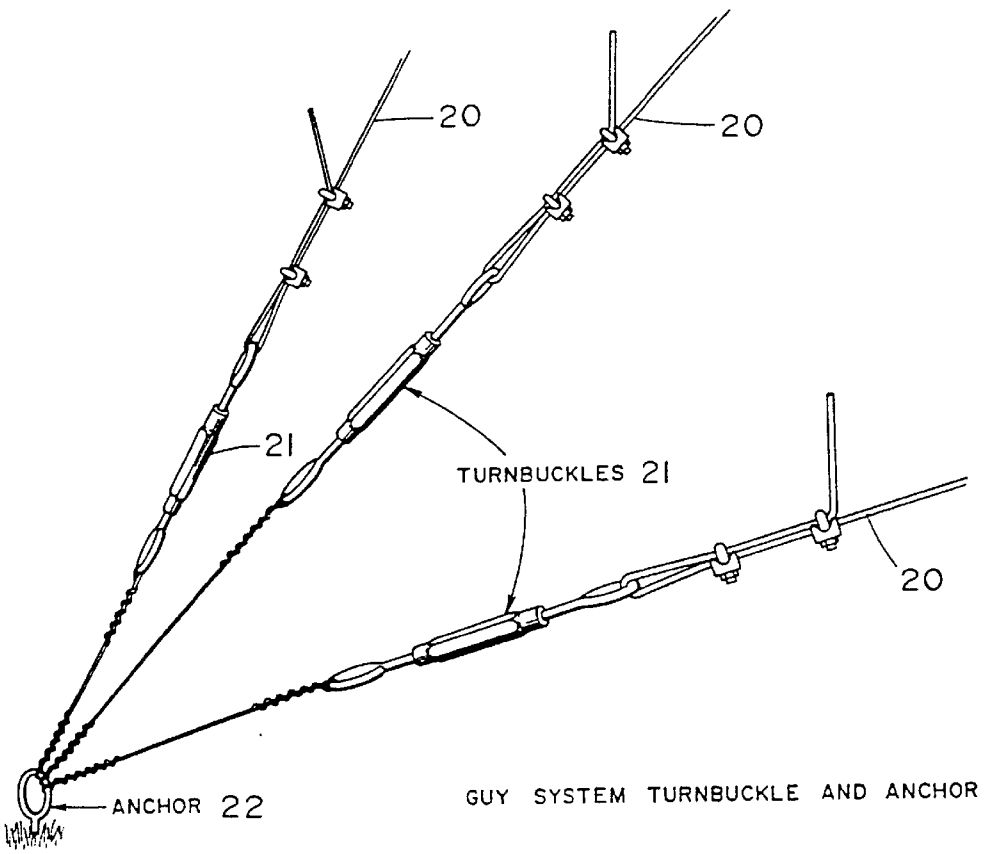
FIG. 19 illustrates the method of anchoring antenna mast guy lines by means of a ground anchor.

Performance data for operation of the antenna on one portion of the 160 meter band is shown in FIG. 16 which depicts a 2:1 SWR bandwidth of 56 KHz. FIG. 17 shows a 90 KHz. 2:1 SWR bandwidth obtained for one portion of the 80 meter band. FIG. 18 shows a 91 KHz. 2:1 SWR bandwidth obtained for a relatively lower portion of the 80 meter band achieved with a length of capacitor 62 slightly greater than the length used to achieve the FIG. 17 data.

By using a trap T as shown in FIG. 14 between the mast 2 and one of the skirt wires A, a gain of over 150 kHz of spectrum in the 40 meter band can be achieved. Similar benefits for 40 meter operation are achieved with the skirt system C describe herein. This improved spectrum of acceptable operation when selectively operating in this 40 meter band of shorter wavelengths occurs without significantly affecting selected operation in the 160 and 80 meter bands.

Performance and Specification

Power rating: CW 1 KW, SSB 2 KW

Bandwidth (2:1) SWR points: 160 Meters 50 kHz

80 Meters 87 kHz

Trap can be added for additional band (i.e. 40 meters)

Feed point impedance: 50 Ohm (±5)

SWR at resonance: 1.5:1 or Less

Recommended feed line: RG213/U, 50 ohm, 5000 volt

Number of ground radials: 6 Minimum

Radial length: 34 ft.

Height: 31' 3"

Mast: Telescoping (Galvanized Steel)

Top Hat: Aluminum tubing and #14 Copperweld wire, 17 ft. dia.

Foot print w/guy system: 625 sq. ft.

Wind surface area: Approx 9 sq. ft. estimated

Shipping weight: 47 lbs.

Figure 22:
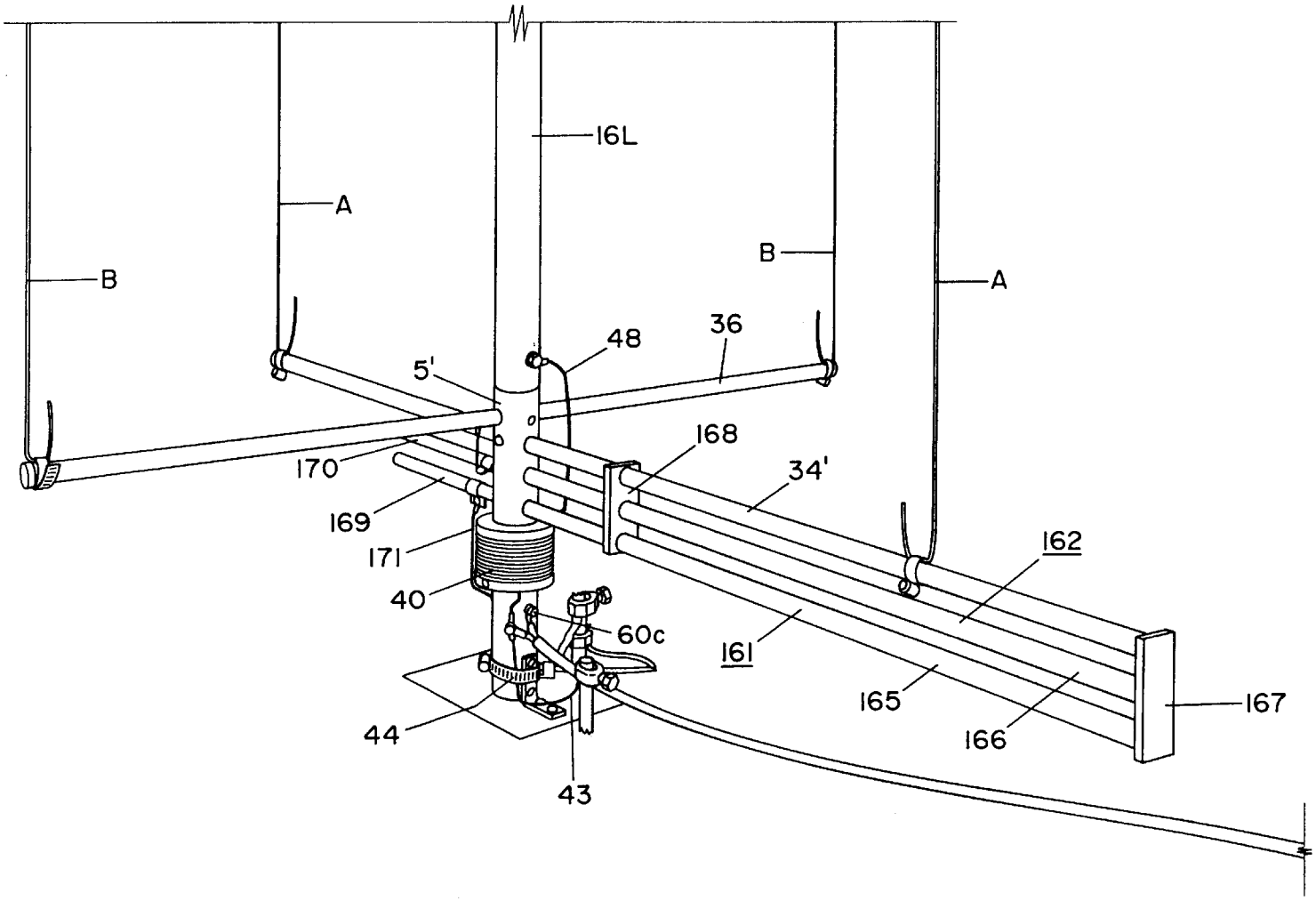
FIG. 22 is a perspective view of the lower portion of an antenna system showing an alternative embodiment using feed capacitors made from telescoped sections of rigid metal tubing and supported in electrical connection with a skirt wire spreader arm and extending through an insulating mast support base.
Figure 23:
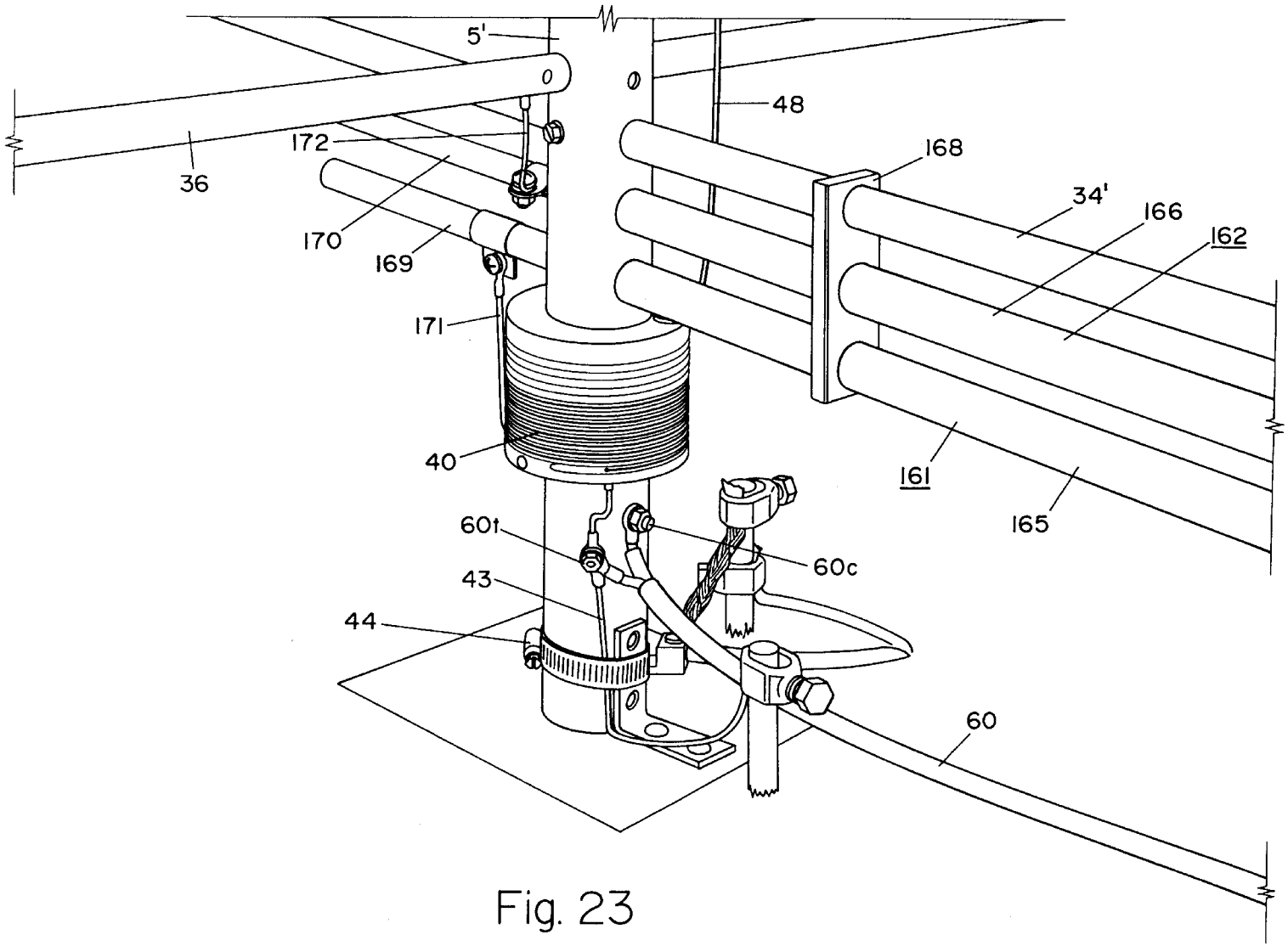
FIG. 23 is an enlarged view of part of FIG. 22.
Figure 24:
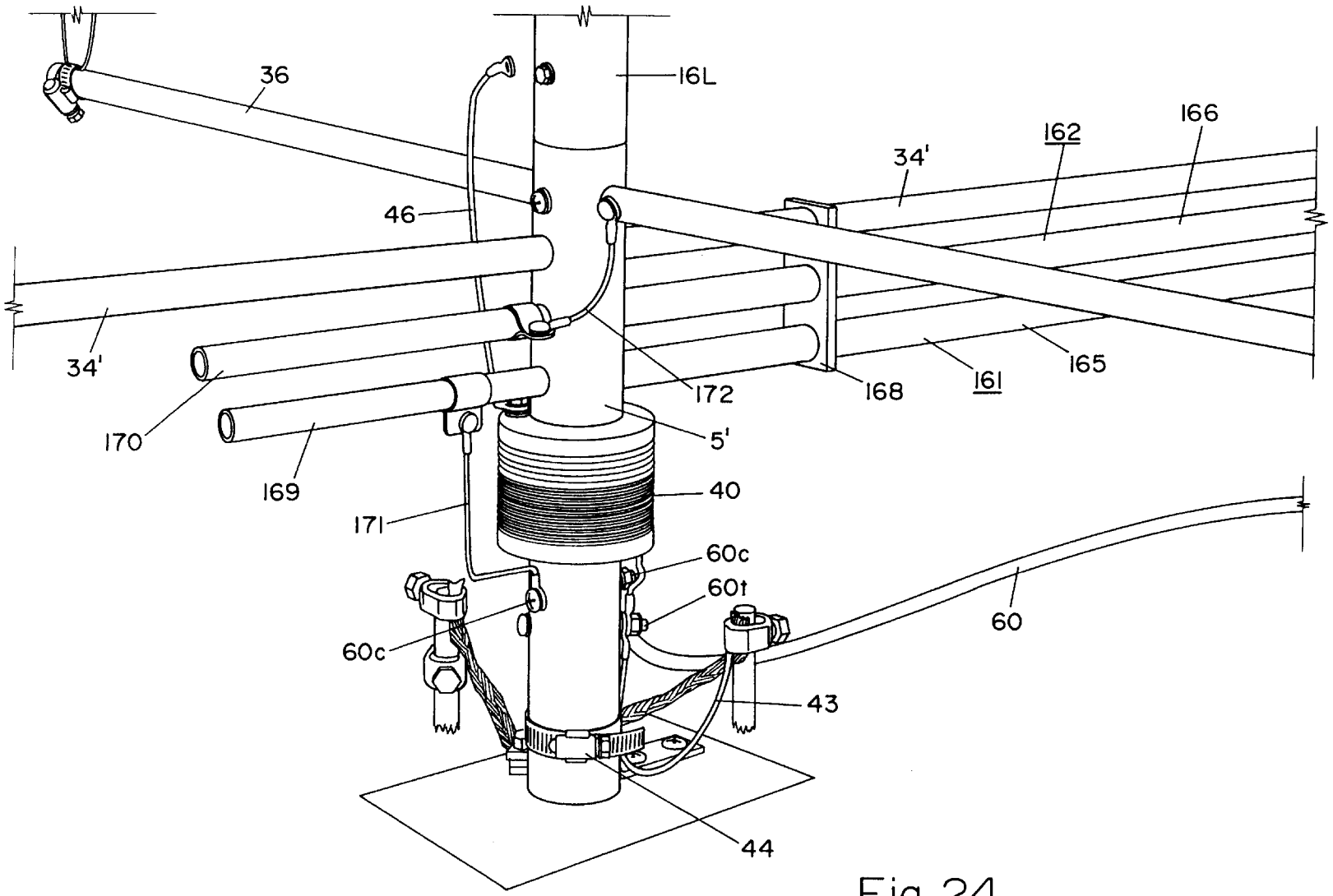
FIG. 24 is a view similar to FIG. 23 taken at another angle about 90° clockwise from FIGS. 22–23.
Figure 25:
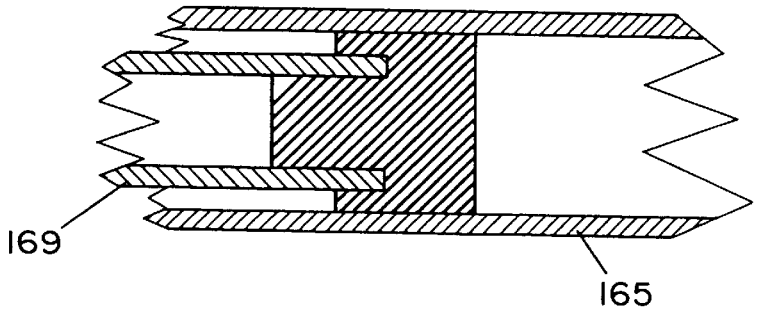
FIG. 25 is a partial section illustrating an insulating plug in the end of an inner sliding tubular capacitor member to support the sliding member coaxially within a tubular capacitor stator member.

An alternative embodiment for the two feed capacitors 61 and 62 is shown in FIGS. 22–24 wherein the capacitors 161 and 162, corresponding in function to capacitors 61 and 62 are each formed with sections of telescoping rigid aluminum metal tubing. In this embodiment the spreader tube member 34' has been elongated so as to have an end portion extending a sufficient beyond one of the skirt wires A to support the outer ends of the stator members 165 and 166 of capacitors 161 and 162. A metal plate 167 is welded to the ends of tubes 34', 165 and 166 to secure them together and seal the outer ends of the tubes against the entry of moisture or contaminants. A similar welded plate 168 secures the tubes together at a point near the mast support insulating base means 5'. The elongated insulating portion of the insulating base 5' has two transverse passages therethrough parallel to and just below the hole for the spreader member tube 34'. The unitary subassembly of the spreader tube 34' and the tubes 165 and 166 can be slid into the parallel passages in the insulating base 5' during assembly of the antenna before attaching the skirt wires A. The tubes 165 and 166 are secured in and extend from counterbored portions of these passages and tubular axially slidable movable capacitor members 169 and 170, of capacitors 161 and 162, extend through the passages and into the tubes 165 and 166. The outer ends of the tubes 169 and 170 are sealed with metal caps to prevent entry of moisture. The tubes 169 and 170 fit snugly with the smaller bore portions of the transverse counterbored passages and are held thereat coaxially with the tubes 165 and 166. As illustrated in FIG. 25, the ends of tubes 169 and 170 within the tubes 165–166 have insulating plugs secured therein, as with epoxy, and these plugs have radially enlarged portions which engage and slide along the inner surfaces of tubes 165–166 to keep the tubes 169–170 and 165–166 coaxial. Small caps of insulating material can be securely sealed to the insulating base 5' and provided with apertures with O-ring seals around the tubes 165–166 and 169–170 to further help seal the interior of the capacitors 161 and 162 against the entry of moisture.

The center conductor of feed cable 60 is connected to a screw connector which passes through the insulating base 5' and is connected at the opposite side of the mast to a stiff wire conductor 171 having an upper end electrically clamped to the tube 169 as seen in FIG. 24. Another wire jumper 172 connects tube 170 to spreader member 36. The shield conductor of cable 60 is connected to the grounding wire and clamp 43–44. The electrical function of this embodiment will correspond to that described for the preferred embodiment.

With the construction of FIGS. 22–24 the exposed portion of the inner conductor extending outwardly from the small bore provides convenient means for making connection of the electrical feed to the capacitor as well as facilitating manual axial sliding adjustment of the inner conductor relative to the stationary outer conductor without the necessity of having to trim cable as with the preferred embodiment.

Since air has a voltage breakdown level of about 21 volts per mil and a dielectric constant of unity, a capacitor can be made to withstand a higher voltage and/or be made smaller by use of a dielectric which has several hundred to a thousand or more times higher voltage puncture resistance level than air and a dielectric constant that is several times higher than air. Coaxial tubular capacitors may be made with tubular members forming a dielectric and enabling the axial adjustment for tuning.

Figure 26:
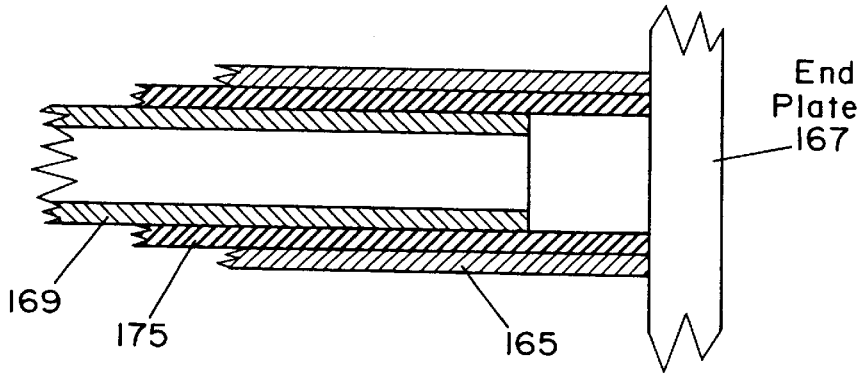
FIG. 26 is a view similar to FIG. 25, but illustrating an alternative structure in which a sleeve of insulating dielectric material lines the entire inside length of the tubular capacitor member.
Figure 27:
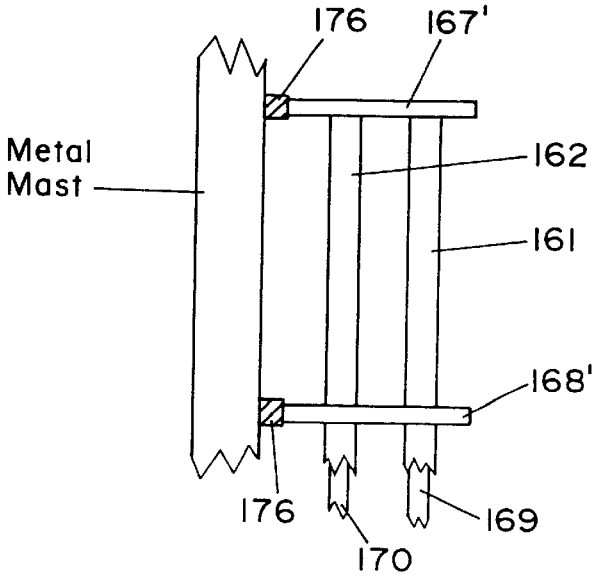
FIG. 27 illustrates another embodiment in which feed capacitors using telescoped tubular metal members similar to those of FIGS. 22–26 are supported in insulated relationship and vertically parallel to the lower end of the antenna mast near the center of a quadrant defined by two skirt wire spreader arms.
Figure 28:
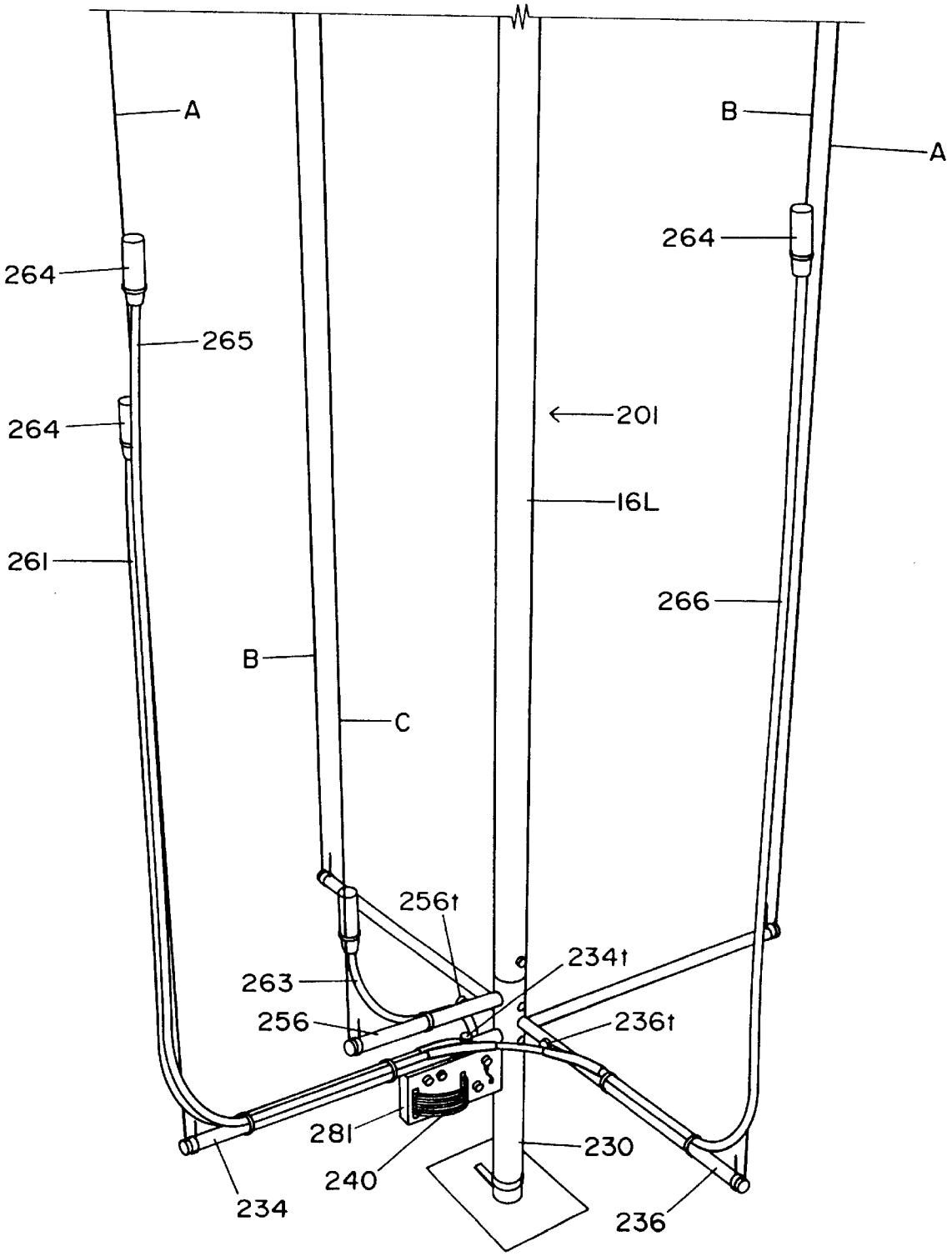
Figure 29A:
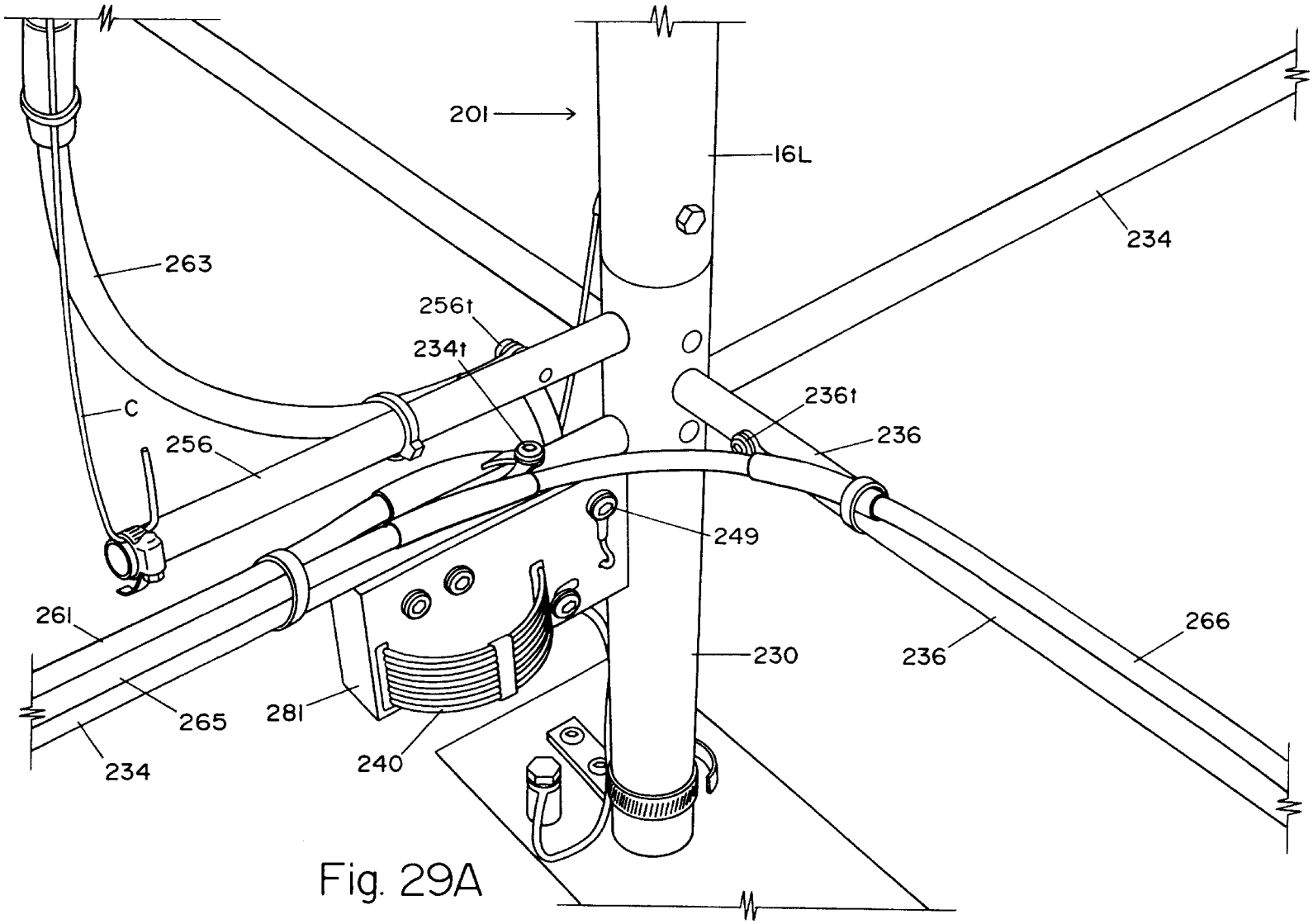
FIGS. 29A and 29B each show an enlarged view similar to FIG. 28, but showing greater detail of antenna components near the mast.
Figure 29B:
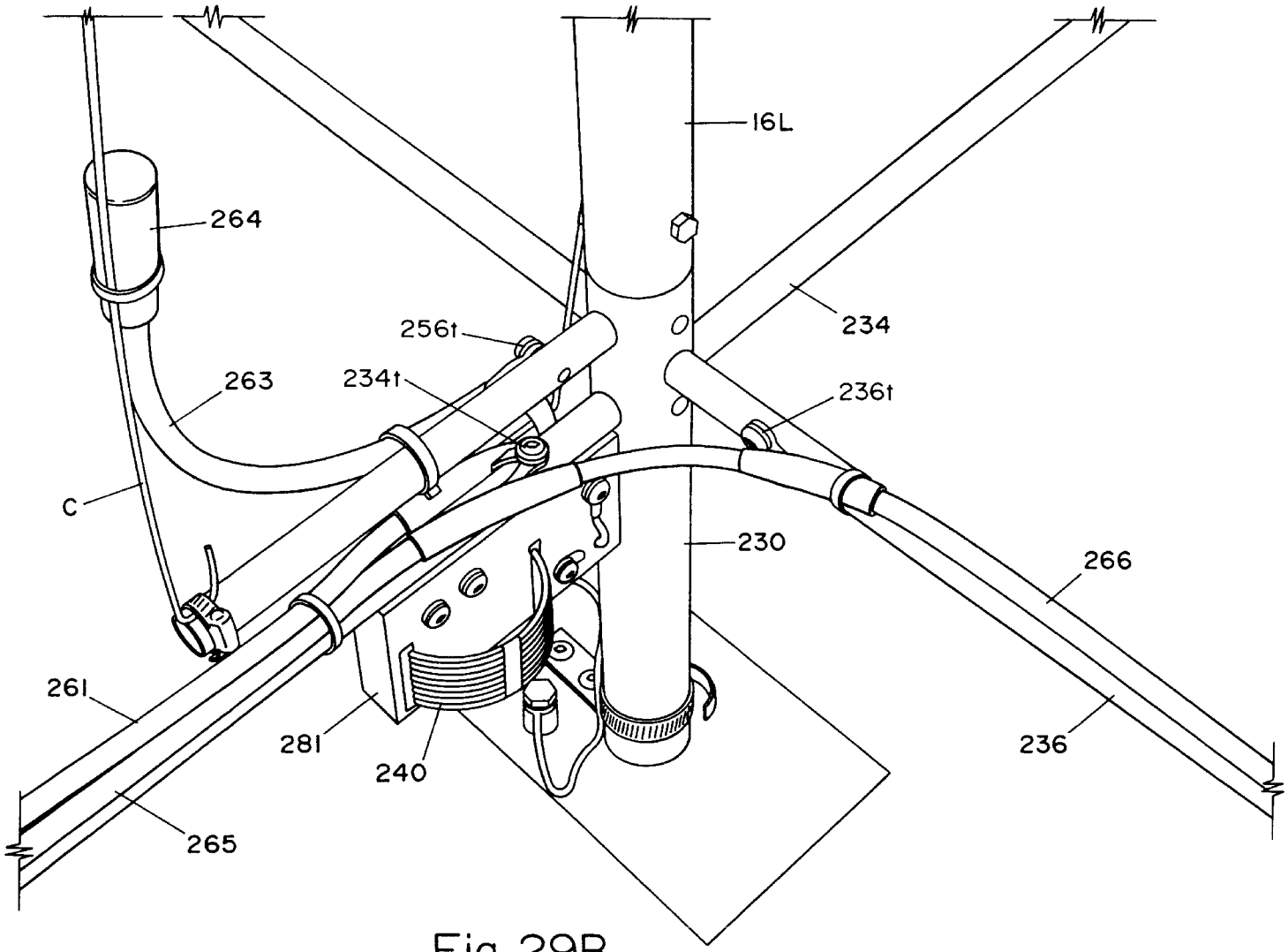

A further alternative to the embodiment of FIGS. 22–24, which uses air as the dielectric of the capacitors 161 and 162, is to replace the insulating plugs of FIG. 25 with insulating sleeves 175 as seen in FIG. 26 extending the entire length of the inner surfaces of the tubes 165 and 166 to keep the telescoped tubes coaxial as well as providing material of higher dielectric constant between the capacitor electrodes. Insulating material will also increase the resistance to electrical arcing between the electrodes. Both characteristics enable reduction in size of the capacitors.

The assembly of capacitors 161 and 162 may be mounted on and in insulated relationship to the metal mast by insulators 176 and plates 167' and 168' with the lower ends of the inner capacitor members hanging downwardly in a quadrant between two spreader arms. Such an arrangement helps to prevent moisture from entering the capacitor assembly under rainy conditions. Appropriate electrical connections corresponding to those of the other embodiments will be made to the capacitor components.

When the present invention is used under high power conditions, such as 1000 watts or more output to the antenna system, the high voltages at the connectors for the coaxial capacitors necessitate the use of components that will not permit any arcing or leakage at the connectors. This may entail use of premium quality connectors having silver plated conductors and the use of silicone grease at the connections to eliminates air at the electrodes and minimize the likelihood of arcing breakdown. Such connectors are commercially available with voltage ratings of 10,000 volts or more.

Another acceptable high quality, but more costly, alternative for the capacitors 61–62 or 161–162 is to use small vacuum variable capacitors having voltage ratings of 10,000 volts or more, such as a Jennings USLS-465 capacitor having a range of 7 pf to 465 pf. This capacitor has about a 3" dia. and is about 4" long with an adjustable screw shaft. Suitable means may be provided to support it on the insulating base 5.

Another embodiment of the antenna is illustrated in FIGS. 28–32. In this embodiment most of the antenna system structure is essentially identical to the antenna embodiment of FIGS. 1–12 and 19–21 which utilize reference numerals 1 through 64. The skirt wire system includes two sets or pairs of skirt wires A and B in respective mutually perpendicular vertical planes as in the previous embodiment. However, in this embodiment there is a third skirt wire system having a skirt wire C connected between the outer ends of cantilevered horizontally extending lower spreader tube member 256 and upper spreader tube member 257 which are made of aluminum and extend outwardly from the vertically extending antenna structure 201 in a vertically extending plane essentially coinciding with the plane of the two skirt wires A.

In this skirt system the skirt C is used in lieu of the trap T of FIG. 14 for operation on 40 meters. This 40 Meter skirt wire is about 116 inches long including its pigtails and has an effective length of 106 inches between the spreader arms 256 and 257 which keep the skirt C parallel to and 9 inches from the mast 2.

Where the modified part is similar to structure of the prior embodiment, reference numerals have 200 added to the numeral to indicate the modification, i. e., the spreader tube for anchoring the lower ends of skirt wires A has become 234 instead of 34. As seen in FIG. 30C, the fixed end of the lower spreader tube 256 is anchored beneath the lower end of the mast section 16L by bolts in a horizontal transverse bore in the upper end portion of an mast-supporting insulating body 230. The fixed end of the upper spreader tube 257 extends through and is bolted within a bore in an insulating supporting block 258 and has an end portion projecting slightly from the block 258 into electrical contact with the outer surface of the upper end of the metal lower mast section 16L just above the anchoring point for the lower set of guy cables seen in FIG. 31. The projecting end portion of tube 257 is secured in electrical contact with the mast section 16L by means of a metal hose clamp 259 extending through transverse aligned holes in the block 258 and tube 257 and around the mast section 16L. The ends of the taut skirt wire C are secured in electrical contact with the ends of spreaders 256 and 257 by means of small metal hose clamps.

Figure 32:
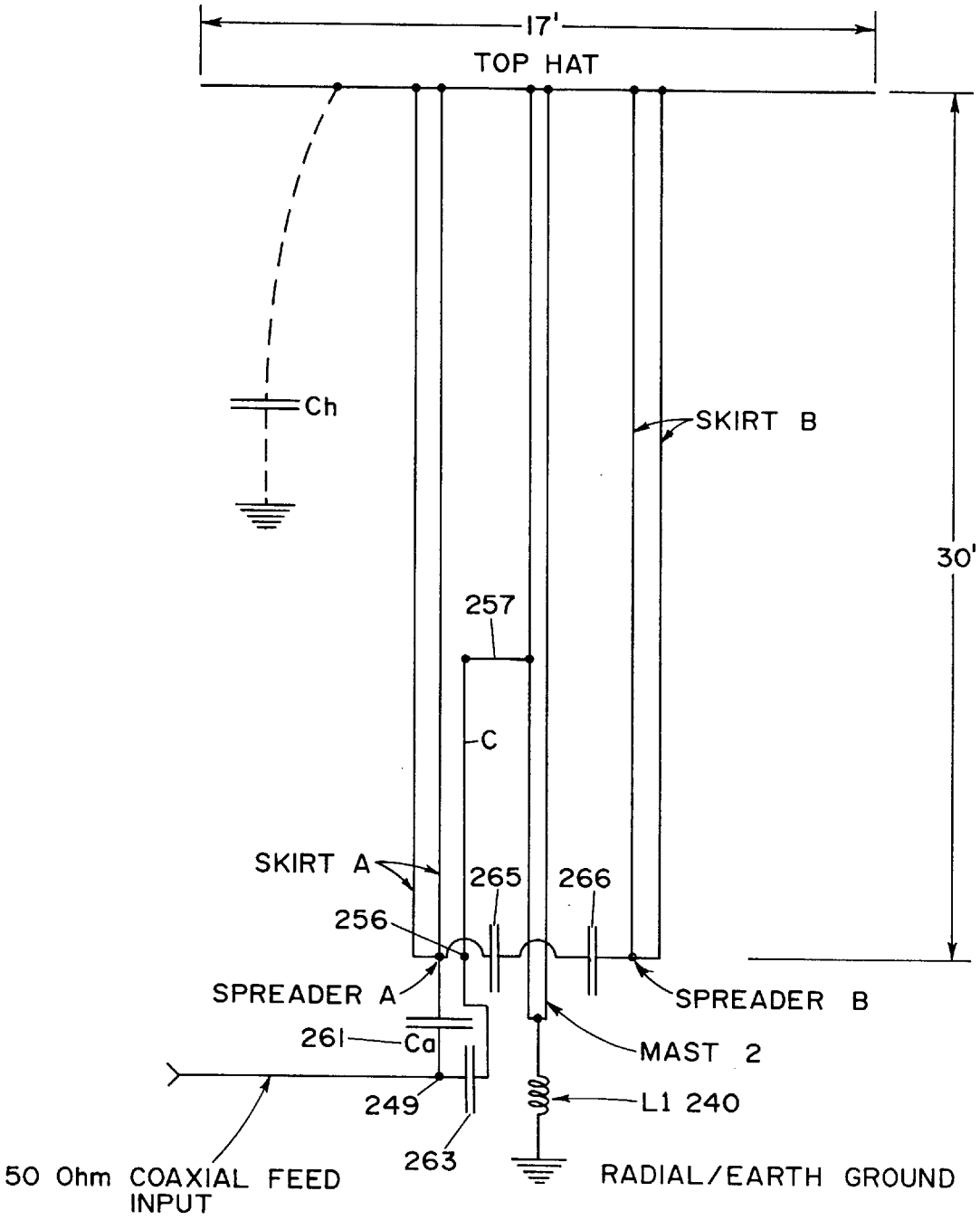
FIG. 32 is a schematic/diagrammatic representation of the electrical components of the antenna system of FIGS. 28–31.
Figure 32A:
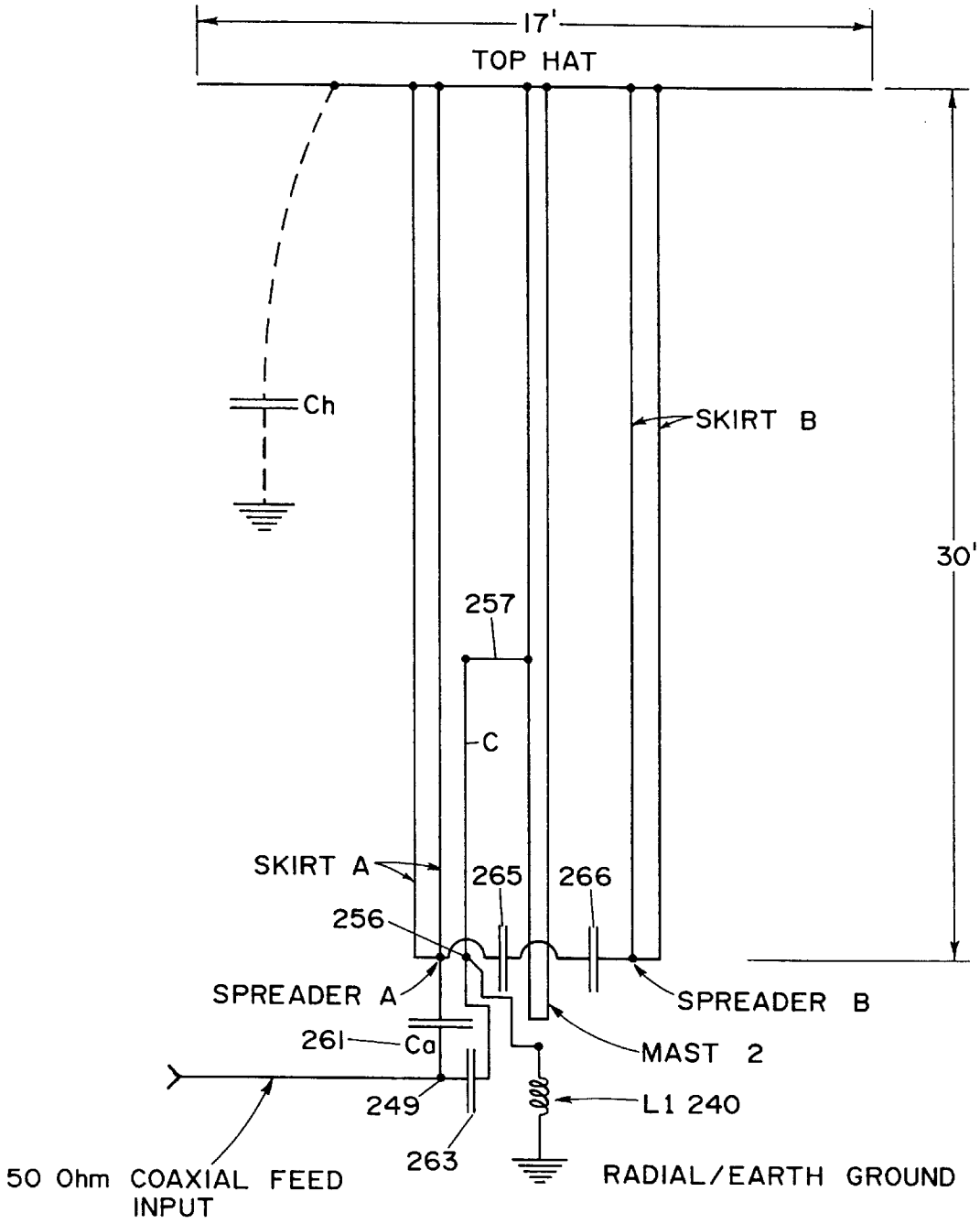
FIG. 32A is a schematic/diagrammatic representation similar to FIG. 32, but showing an impedance transformation coil connected from ground to the mast via a skirt wire C for efficient improved 40 Meter operation.

The circuit diagram of FIG. 32 shows the skirt C extending upward from the shorter spreader arm 256 to another short spreader arm 257 connected to the mast 2 and also shows the upper end of the coil 240 connected to the lower end of the mast 2. This circuitry tends to cause the selected tuned centering frequency in the 40 meter band to shift within this band when the antenna system is tuned to operate in a different part of the 160 meter band. The 160 Meter tuning will affect the center band position of the 40 Meter band and vice versa. This dependence on the 160 meter tuning can be reduced by disconnecting the upper end of coil 240 from the bottom end of the mast and connecting it to the spreader arm 256 as seen in the schematic of FIG. 32A. This connects the coil to an intermediate point on the mast via the skirt wire C and spreader 257 and can be done, for example, by disconnecting the wire 246 in FIG. 30B from the screw terminal shown on the lower end of the mast and reconnecting it at the terminal 256*t* on the spreader arm where the sheath of coupling capacitor 263 is also connected. This circuit change requires a longer length (greater capacity) in the capacitor 263 and a shorter length (less capacity) in the capacitor 261 (Ca) feeding spreader arm 234 and skirt wires A when trimming the antenna system to tune it for 160 meter operation. This change is very significant and makes the tuning of the antenna less critical and easier on all bands of operation without changing or sacrificing efficiency of the antenna as the selected operating frequency is changed. Tuning operations in 160 and 40 Meter bands are made more independent of each other.

Figure 32B:
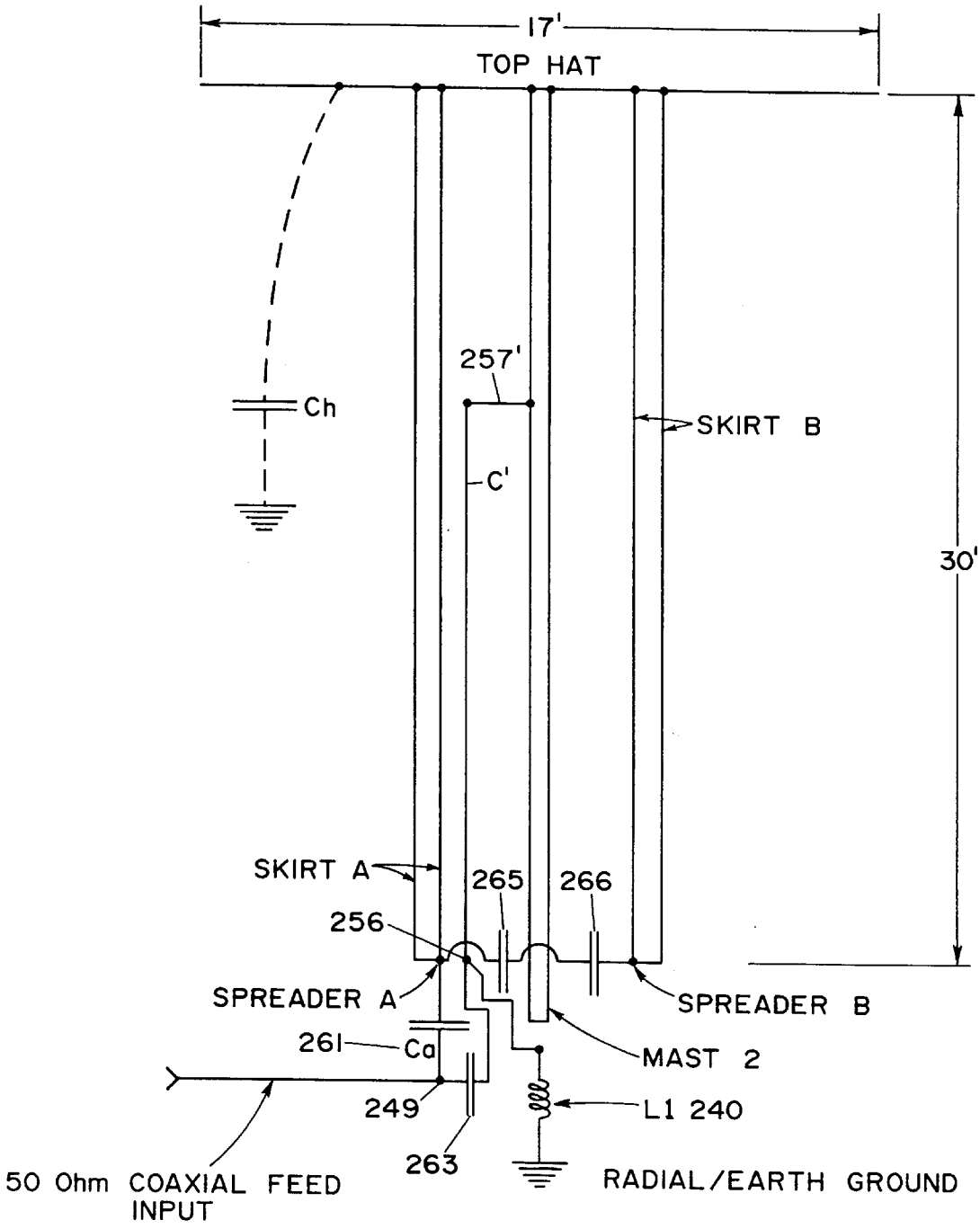
FIG. 32B shows a longer skirt wire C' enabling efficient 20 Meter operation.
Figure 33:
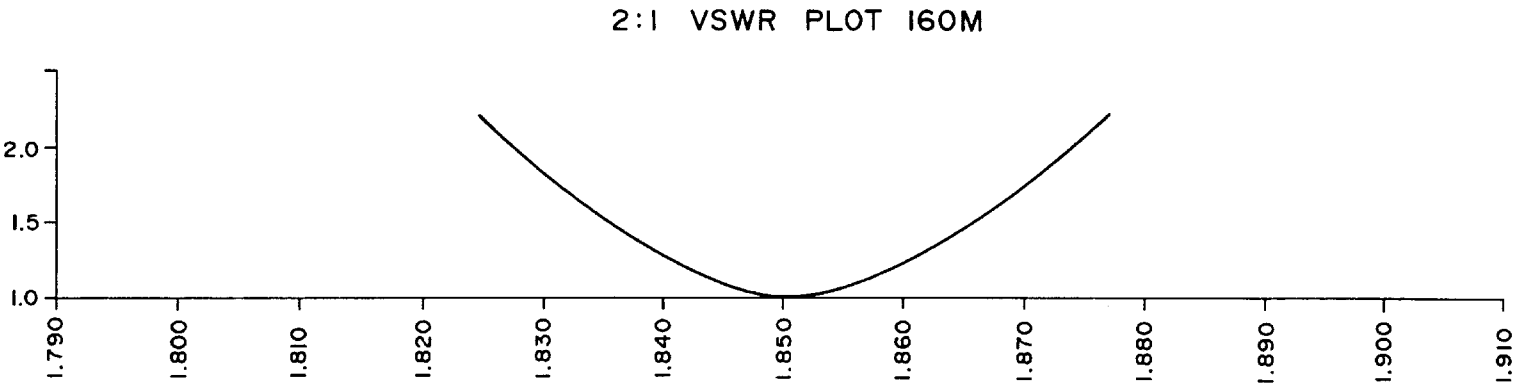
FIGS. 33–36 are plots of standing wave ratios (VSWRs) versus frequency for operation of the antenna system of FIGS. 28–32 on 160, 80, 40 and 17 meters, respectively.
Figure 34:
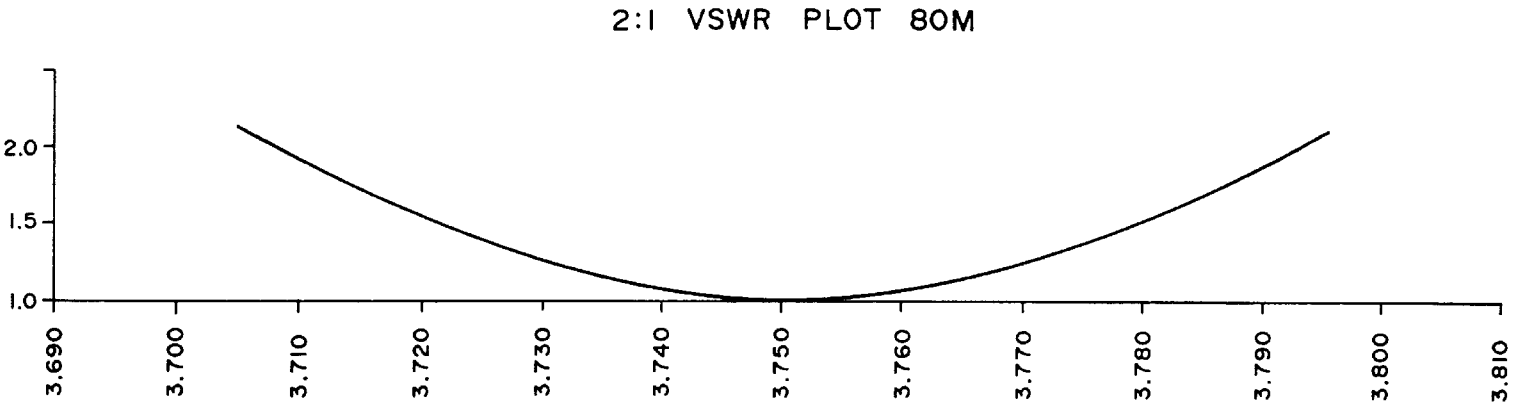
Figure 35:
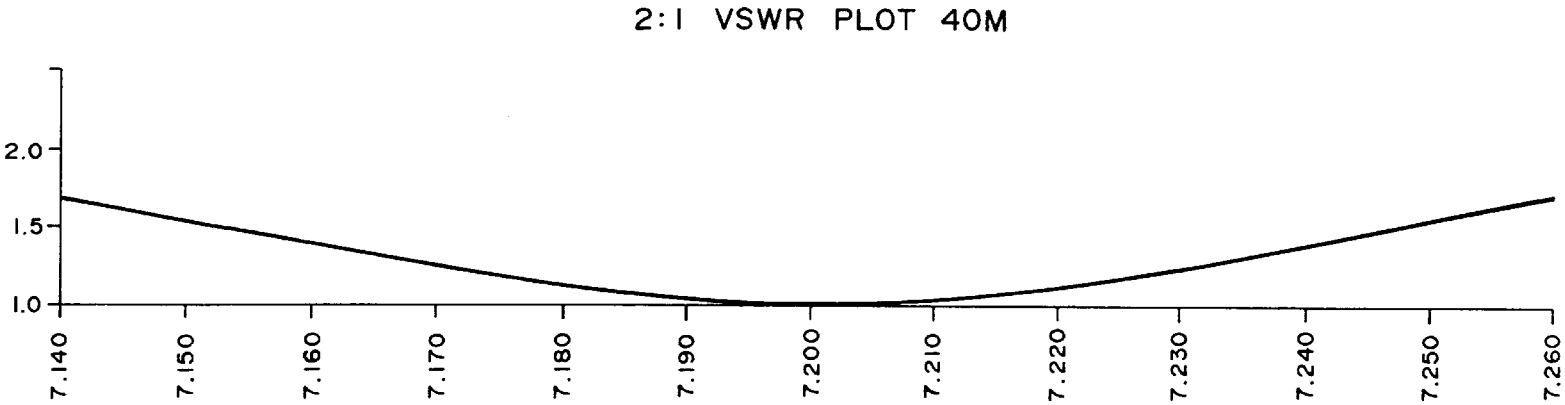
Figure 36:
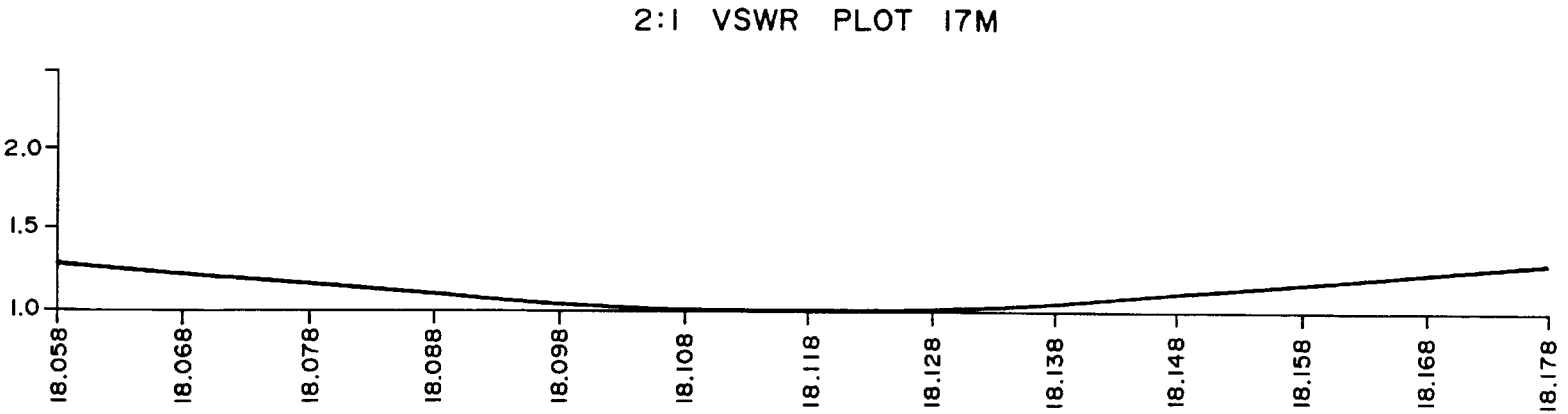

If the skirt C is essentially doubled in length to 212 inches, the antenna system will operate on both 40 Meters and 20 Meters. Such an arrangement with the coil again connected to an intermediate point on the mast via the skirt C' and its supporting arm 257' is shown in FIG. 32B.

Other variations of the antenna of FIGS. 28–32 over the prior embodiment appear in the details of the construction and mounting of the coil 240 at the side of the insulating body 230 and the manner of coupling energy to and from the antenna for multi-band operation.

The coil 240 is mounted on an insulating rectangular block 281 which is secured by screws or the like to the underside of spreader arm 234 at one side of and against the insulating body 230. The coil is prewound to provide an inductance of values corresponding to coil 40. Opposite sides of the coil are slid into slots 281 extending upwardly from the lower edge of the block 281. These slots are filled with a suitable insulating potting compound to anchor the coil. The upper end of the coil is connected to a terminal 245 on the block 281. A coil tap near the upper coil end is connected to a second terminal 247 on the block 281. A wire 246 electrically connected to the mast section 16L may be selectively connected to either of terminals 245 or 247 to select different values of coil inductance in the same manner as selection is made for coil 40 in the prior embodiment. The lower end of the winding of coil 240 is connected on the support block 281 to the outer terminal of a coaxial connector 242 and from there via ground wire 243 to ground and to ground plane wires as described in connection with FIG. 2.

The center conductor of connector 242 is connected on the support block 281 to a terminal 249. The connector 242 forms the feed point for the antenna. The feed is coupled via a coaxial cable capacitor 261 to spreader tube 234 and the skirt wires A connected thereto. The center conductor at one end of capacitor 261 is connected to terminal 249 and the sheath at this same end is electrically connected to a terminal point 234*t* on spreader arm 234. The cable capacitor 261 extends out along the arm 234 and then up along one of the skirt wires A where its upper other end is electrically open. Spreader arm 234 and the skirt wires A are coupled to spreader arm 236 and skirt wires B by means of two serially connected coaxial cable capacitors 265 and 266 which are conveniently formed from a single length of coaxial cable. This cable has its outer shield sheath electrically separated near the center of the cable length and near the antenna mast to define the two cable capacitor sections 265 and 266, each forming a respective one of the serially connected coupling capacitors. At the point of sheath separation the sheath for cable capacitor section 261 is connected to the terminal 234*t* on spread arm 234. This capacitor section extends parallel to the capacitor 261 out along spread arm 234 and up along the respective skirt wire A. Near the mast the other capacitor section 266 has its sheath electrically connected to a terminal 236*t* the spreader arm 236. The section 266 extends out along spreader arm 236 and the up along the skirt wire B at the end of the arm. The cable capacitor sections are held in place along arms 234 and 236 and along skirt wires A and B by suitable plastic ties. Since the center conductor is continuous throughout the cable capacitor sections 265 and 266 and is not connected to any other circuitry, it forms the common connecting point between the serially connected capacitor sections 265 and 266.

The center conductor of another coaxial cable coupling capacitor 263 is connected to terminal 249 on the support block 281 and the sheath of this capacitor is connected to a terminal 256*t* on the cantilevered tube 256 near the insulator body 230 to provide coupling between skirt wire C and the feed connector 242. The cable capacitor extends out along tube 256 and up along skirt wire C and is similarly held in place by plastic ties.

The skirt wire C for 40 meter operation is about 116 inches long with pig tails and has a useful length parallel to the mast between the spreader arms 256 and 257 of 106 inches. Its distance from the mast is 9 inches. The tuning stub 263 has an overall length of 18 inches with a useful length of approximately 13¼ inches. Because of the very flat VSWR on 40 meters this tuning stub does not have to be trimmed for frequency selection within the 40 meter band.

The terminating point of the short feed line, which also functions as an impedance transformer and radiating elements, is at the top hat inner loop. The top hat contributes to the low angle of radiation of the antenna system which is typically 10 to 12 degrees. The combination of the top hat and short feed line radiating elements produces the high efficiencies of the antenna system.

The outer shields of the coaxial cable tuning capacitor stubs are at the same RF potential as the spreader arm rods so there will be no interaction between the lengths of these tuning stubs and the spreader members and skirt wires along which they extend. During tuning the upwardly extending free electrically-open ends of the stubs for skirt sets A and B remain uncapped to facilitate tuning pruning. After tuning, sealing caps are installed to prevent moisture from entering the stubs.

Figure 30A:
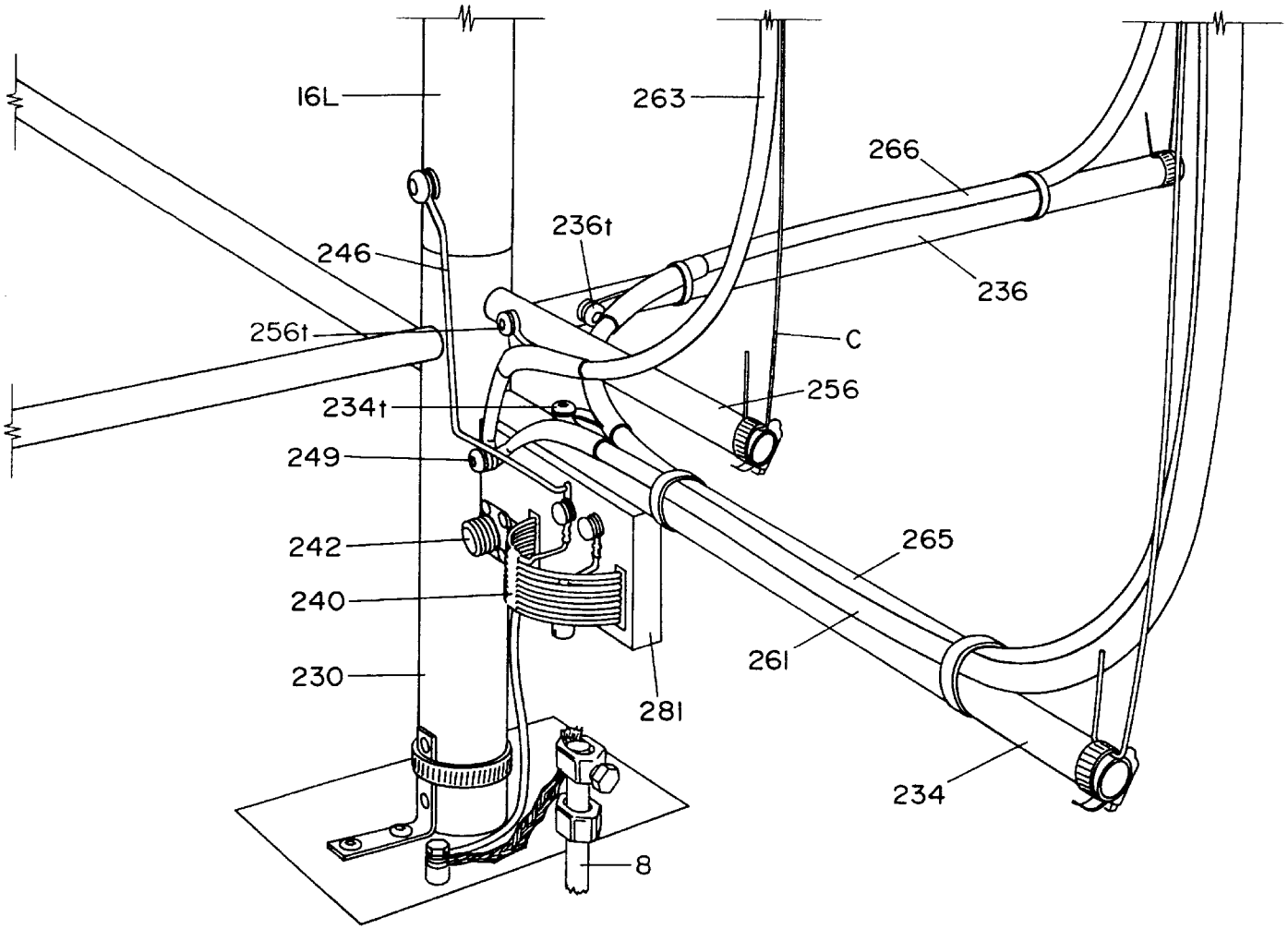
FIG. 30A is a perspective view looking down on the lower or base portion of the antenna from a position about 90° clockwise around the mast from that of FIG. 28, but on a different scale.
Figure 30B:
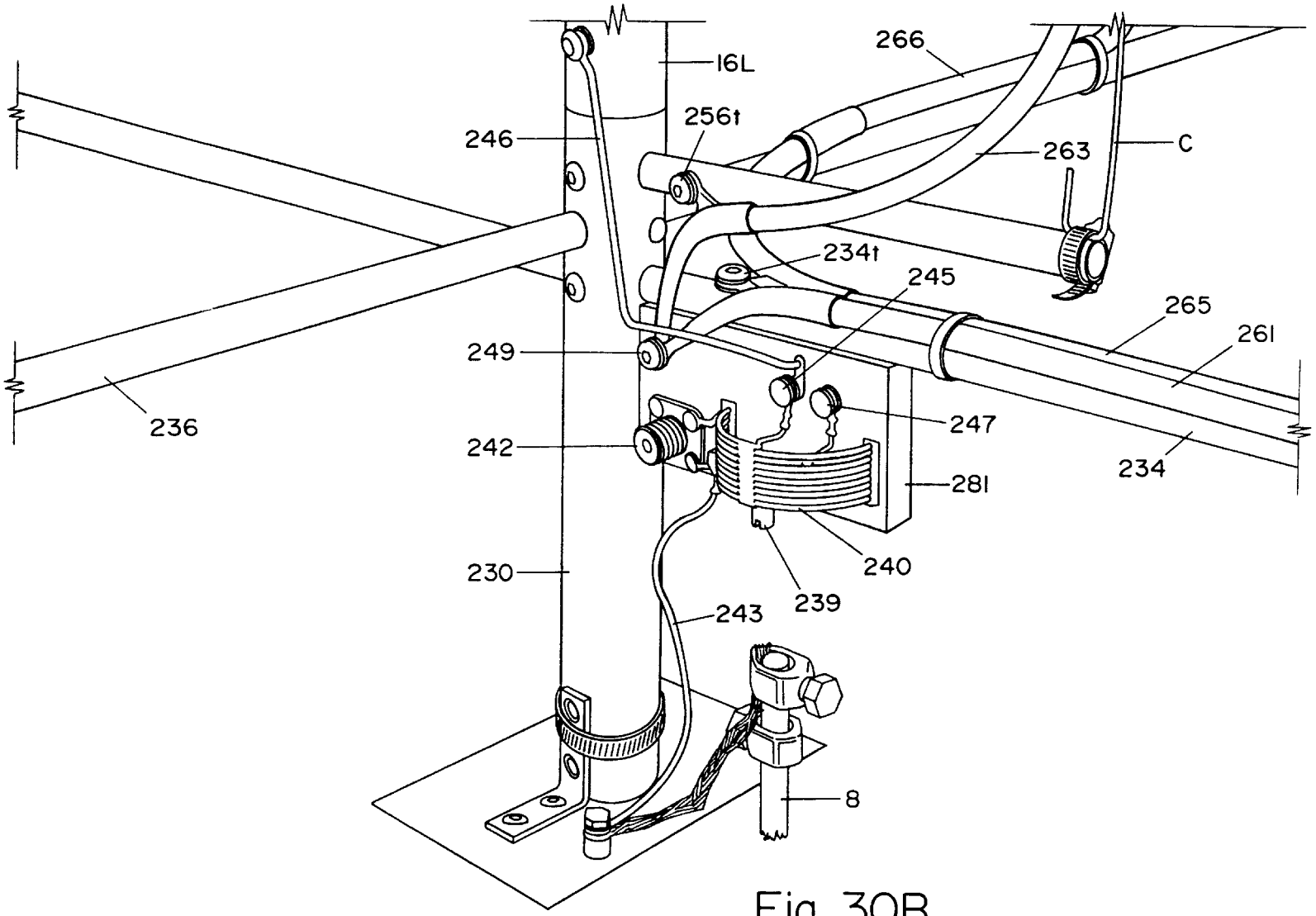
FIG. 30B is a perspective view similar to that of FIG. 30A, but taken at a lower angle further clockwise around the mast.
Figure 30C:
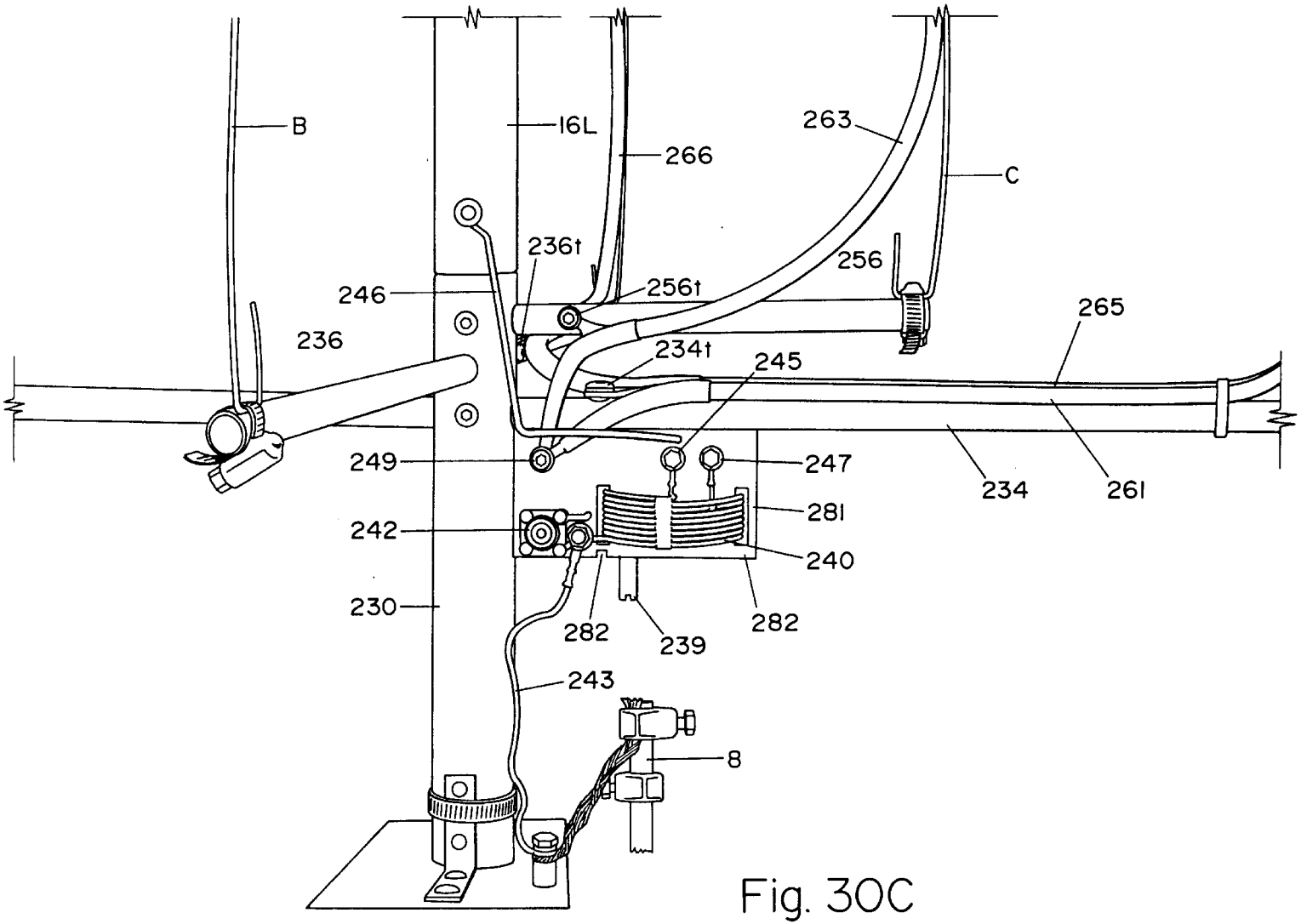
FIG. 30C is a perspective view similar to that of FIG. 30B, but taken at a still lower angle and further clockwise around the mast showing the horizontal orientation of a short lower cantilevered skirt-tensioning bar.
Figure 31:
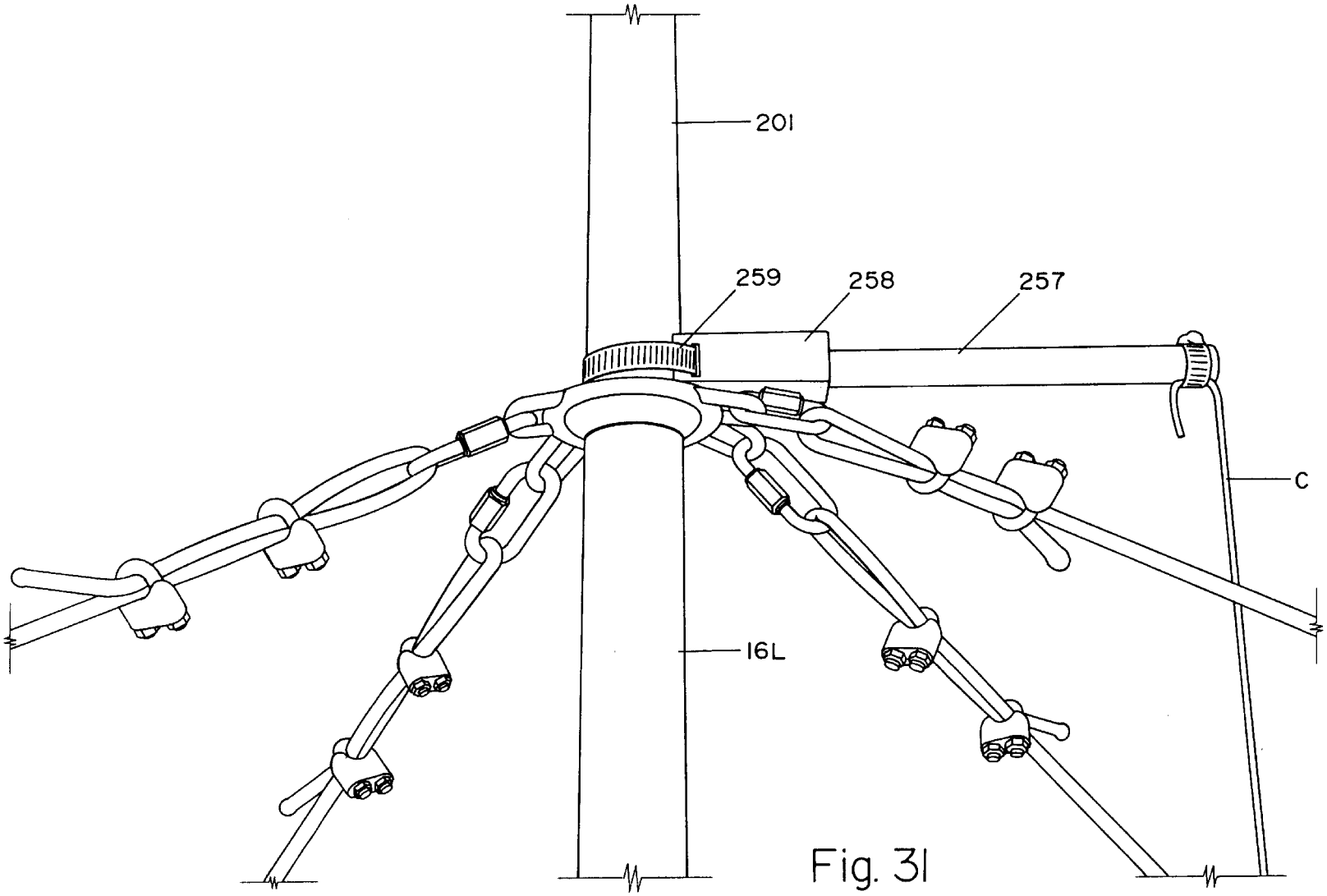

Tuning using the coil tap at terminal 245 in FIG. 30B may be preferable to select a portion of the 160 meter band where most of the operation in this band is likely to occur. It is important that terminals 245 and 247 not be externally connected together during tuning or operation.

During initial tuning for 160 meters by pruning tuning stub capacitor Ca, the ferrite tuning slug 239 seen in coil L1 in FIGS. 30B and 30C is removed and the capacitors 265 and 266 are shorted by a jumper across spreader arms 234 and 236. The ferrite slug 239 is inserted for fine tuning on 160 meters. During subsequent tuning for 80 meters, the shorting jumper is removed and the pruning of tuning capacitor stubs 265 and 266 should be alternated to keep these stubs at essentially the same length since they are connected in series and should have equal RF voltages and currents applied during operation. This provides maximum resistance to voltage breakdown in this series chain of capacitors.

During tuning and operation, close proximity of large metal objects such as vehicles or ladders or scaffolding will detrimentally affect operation of the antenna system. Human body capacitance within the perimeter of the lower ends of the skirt wires as during fine tuning with the ferrite slug may affect the tuning The person adjusting the slug should back away to check the effects of adjustment.

Computer models of the field patterns of the antenna of this invention produced with the aid of Numerical Electromagnetic Code standard revision level 4 (NEC-4), 1995, revealed a radiation pattern having a maximum field strength upwardly and outwardly at about 20 degrees above the horizontal. Models were derived for a frequency of 1.66 mHz, Cond.=5 mS/M, Dielectric Const.=15, input power of 1 kW and using 6 and 12 ground radials of 40 meters. Using 6 radials the field strengths at 1 mile and 10 miles were about 78 mV/M and 9.5 mV/M, respectively. These field strengths were about 74% and 91% of the strengths computed for a standard ¼ Wave Monopole which was used for comparison. Using 12 radials the field strengths at 1 mile and 10 miles were about 97 mV/M and 9.5 mV/M, respectively. These field strengths were about 85% and 91% of the strengths computed for a standard ¼ Wave Monopole which was used for comparison. These field strength percentages are directly related to the efficiency of the antenna and are comparable to strengths measured for the antenna. The antenna has a good surface wave signal. The Code predicted a field strength of about 30 mV/M at one mile for 100 Watts of transmitting power. Actual measurements were very near this value. The polar plots for the present antenna have shown the signal was within about 10 to 25 percent of the full size ¼ Wave Monopole. The band width was found to be better than both a full sized vertical and other short verticals. The usual short top loaded antenna using a load coil to compensate for small size is an extremely narrow band antenna that is very sensitive to small changes in the ground system. The present antenna has been found to be relatively insensitive to ground effects once it is tuned up and has a bandwidth which was found sufficient to meet requirements for digital stereo broadcasting.

Although the radial systems suggested for this antenna are relatively minimal compared to those often installed at great expense, the present antenna can present a 50 ohm resistance at its input with zero reactance. This is attainable notwithstanding that the antenna is tuned for operation in multiple bands.

The two described embodiments for use on 40 meters have circuit parameters, i. e., the trap of FIGS. 13–14 and the skirt system C of FIG. 32, which are connected in circuit between the input and an intermediate point on the mast to provide an inductive reactance by means of which capacitive reactance of the antenna at 40 meters is counteracted to bring the input reactance to zero, leaving a resistive impedance which has low ohmic losses in the antenna and a radiation resistance corresponding to a very efficient antenna.

Other variations within the scope of this invention will be apparent from the described embodiments and it is intended that the present descriptions be illustrative of the inventive features encompassed by the appended claims.

What is claimed is:

1. A folded monopole antenna system which is physically much shorter than a quarter-wavelength of the lowest frequency of intended operation, the antenna system comprising an antenna base means including an electrical ground means, a vertical electrically conducting structure supporting a plurality of vertically extending conductors defining a skirt configuration depending from an upper end of said structure in spaced relationship to the structure, an electrically insulating support means for supporting said vertical structure on said base means, a capacitive loading top hat means supported by and electrically connected to the upper end of the structure, said capacitive loading top hat means being electrically connected to and supporting upper ends of the vertically extending conductors, spreader means tensioning lower ends of said conductors downwardly relative to the upper end of the structure and maintaining those lower ends in horizontally spaced and electrically insulated relationship to a lower end of said structure and to said ground means, said vertical electrically conducting structure and said skirt configuration providing a transmission-line interaction, impedance transforming means between a portion of said vertical structure and said electrical ground means and including inductive impedance transforming means for optimum impedance matching of the antenna system at said lowest frequency, coupling means for coupling radio frequency signals between a transmission feed line and said antenna system, said coupling means comprising capacitive coupling means between said transmission feed line and a lower portion of said skirt configuration, said impedance transforming means providing at said lowest frequency, in combination with said coupling means, the transmission-line interaction between the skirt configuration and the vertical electrically conducting structure, and said capacitive loading top hat means on said structure, a physically short antenna having low ohmic losses and high efficiency.

2. An antenna system according to claim 1 wherein said vertical structure comprises a vertical metal mast at the center of said antenna system.

3. An antenna system according to claim 2 wherein said skirt configuration comprises a plurality of said conductors arranged symmetrically around said mast.

4. An antenna system according to claim 1 wherein there are more than two conductors in said skirt configuration.

5. An antenna system according to claim 4 wherein there is an even number of parallel conductors in said skirt configuration.

6. An antenna system according to claim 1 for multiband use wherein said skirt configuration comprises a plurality of sets of vertically extending conductors, said conductors being uniformly spaced around said vertical structure with no two successive conductors being from the same set of conductors, and including different coupling means for coupling each set of conductors to said transmission feed line.

7. An antenna system according to claim 6 wherein each set of conductors is connected to said transmission feed line by a different capacitive coupling means.

8. An antenna system according to claim 7 wherein a first capacitive coupling means connects one set of skirt conductors to said transmission line and the capacitive coupling means for another set of skirt conductors includes a capacitive coupling between said one set of skirt conductors and said another set of skirt conductors.

9. An antenna system according to claim 1 wherein said electrically insulating support means supports a coil forming said inductive impedance means connected between said vertical structure and said ground means.

10. An antenna system according to claim 9 wherein said coil has turns which are coiled about a vertical axis.

11. An antenna system according to claim 9 wherein said coil is provided with tap means for selectively adjusting the coil inductance between the vertical structure and said ground means.

12. An antenna system according to claim 1 wherein said capacitive loading top hat means comprises a top hat structure including a plurality of horizontally extending radially arranged metal arms.

13. An antenna system according to claim 12 wherein each of said vertically extending conductors is connected to and supported at an upper end by a different one of said arms and including a conducting ring interconnecting the upper ends of said conductors.

14. An antenna system according to claim 2 for use in a frequency band including 1.8 MHz, wherein said mast is about 30 feet in length.

15. An antenna system according to claim 14 wherein said vertically extending conductors are parallel and each is about 19 inches from the mast.

16. An antenna system according to claim 15 wherein said top hat means is about 17 feet in diameter and includes a conducting ring interconnecting the outer ends of said radially extending arms and an inner conducting ring interconnecting the upper ends of said vertically extending conductors.

17. An antenna system according to claim 1 wherein said electrically insulating support means comprises a vertically oriented insulating member having a lower ground-supported end and an upper end connected to and supporting said vertical structure.

18. An antenna system according to claim 17 wherein said spreader means comprises elongated metal spreader members anchored on said insulating member and extending radially outwardly therefrom, each vertically extending conductor of said skirt configuration being connected to and downwardly tensioned by an end of one of said spreader members.

19. An antenna system according to claim 17 wherein said spreader means comprises two elongated metal spreader members, each spreader member extending through a separate hole in said insulating member and having two of said conductors connected respectively to its opposite ends.

20. An antenna system according to claim 19 wherein said insulating support means carries first, second and third electrical terminal connectors, said first connector providing for connection to a transmission line feeding said antenna system and to said ground means, one terminal of said first connector being connected to a terminal of said second connector, said second and third connectors having common interconnected terminals and having means for connecting the common terminals to one of said spreader members, another terminal of said third connector having means for connecting it to the other of said two spreader members, said second connector providing means for coupling said transmission line to said one spreader member by way of a first open-ended coaxial cable capacitor connected to said second connector, said third connector providing means for coupling said transmission line to another spreader member by way of a second open-ended coaxial cable capacitor connected to said second connector and in series with said first open-ended coaxial capacitor.

21. An antenna system according to claim 20 wherein coaxial cable capacitors are connected to said second and third connectors and extend outwardly along said one spreader member to the end thereof and then upwardly along one of said vertically extending conductors of said skirt configuration.

22. An antenna system according to claim 14 and further comprising an inductive reactance means connected to said mast for providing low reactance operation of said antenna system at an operating frequency in another band of shorter wavelengths.

23. An antenna system according to claim 2 having means for tuning it for operation on 160 meter and 80 meter bands and wherein said mast is about 30 feet in length.

24. An antenna system according to claim 23 and further comprising an inductive reactance means connected to said mast for providing low reactance operation of said antenna system at an operating frequency in another band of shorter wavelengths.

25. An antenna system according to claim 23 and further comprising a series trap extending between said mast and a selected one of said vertically extending conductors for providing improved operation of said antenna system on another band of still shorter wavelengths, said series trap comprising an insulating coil form secured to said mast, an inductance coil wound on said form with one end connected to said mast, a capacitor having a first end connected to the other end of said coil and means connecting the second end of the capacitor to said selected one vertical conductor.

26. An antenna system according to claim 25 wherein said capacitor is an open-end coaxial cable capacitor connected to a connector on the coil form of the trap and supported by and parallel to a wire extending between the coil form and said selected vertical conductor, said wire forming a completion of a series trap circuit from said mast through said coil and through said capacitor to said selected vertical conductor.

27. An antenna system according to claim 1 having means for tuning it for operation on 160 meter and 80 meter bands and wherein said vertical structure is about 30 feet in length.

28. An antenna system according to claim 27 and further comprising an inductive reactance means connected to said mast for providing-low reactance operation of said antenna system at an operating frequency in another band of shorter-wavelengths.

29. A folded monopole antenna system which is physically much shorter than a quarter-wavelength of the lowest frequency of intended operation, the antenna system comprising an antenna base means including an electrical ground means, a vertical electrically conducting mast structure supporting a plurality of vertically extending parallel conductors defining a skirt configuration depending from an upper end of said mast structure in spaced relationship to the mast structure, an electrically insulating support means for supporting said vertical mast structure on said base means, a capacitive loading top hat means supported by and electrically connected to the upper end of the mast structure, said capacitive loading top hat means being electrically connected to and supporting upper ends of the parallel conductors, spreader means tensioning lower ends of said conductors downwardly relative to the upper end of the mast structure and maintaining those lower ends in electrically insulated relationship to a lower end of said structure, said spreader means being supported by said insulating support means, inductive impedance transforming means between a portion of said vertical mast structure and said electrical ground means, coupling means for coupling radio frequency signals between a transmission feed line and said antenna system, said coupling means comprising coaxial cable capacitive coupling means between said transmission feed line and a lower portion of said skirt configuration, said impedance transforming means providing in combination with said coupling means and the skirt configuration and capacitive loading means on said structure a short antenna having low ohmic losses and high efficiency.

30. A folded monopole antenna system according to claim 29 and having an additional skirt system connected to an intermediate point on said mast structure and providing means for reducing the effect of longest wavelength band tuning at the input of the antenna system when the system is tuned for operation at an operating frequency in a frequency band of wavelengths shorter than the nominal longest wavelength band in which the antenna is normally used.

31. A folded monopole antenna system according to claim 30 wherein said inductive impedance transforming means is connected to said portion of the mast structure through said additional skirt system.

32. An antenna system according to claim 29 wherein said skirt configuration comprises a plurality of sets of vertically extending conductors, said conductors being uniformly spaced around said mast with no two successive conductors being from the same set of conductors, and including different coupling means for coupling each set of conductors to said transmission feed line.

33. An antenna system according to claim 32 wherein one set of conductors is connected to said transmission feed line by a coaxial cable capacitor and said one set of conductors is coupled to another set of said conductors by another coaxial cable capacitor.

34. An antenna system according to claim 33 wherein said coaxial cable capacitors have first portions supported by part of said spreader means and have outer conductors at the same potential as one vertically extending skirt conductor of said one set, said coaxial cable capacitors having further portions extending vertically along said one skirt conductor.

35. An antenna system according to claim 32 wherein said inductive impedance transforming means is an adjustable inductance.

36. An antenna system according to claim 35 wherein said inductance is switchable between two values.

37. A folded monopole multiband antenna system which is physically much shorter than a quarter-wavelength of the lowest frequency of intended operation, the antenna system comprising an antenna base means including an electrical ground means, an electrically conducting vertical structure supporting a plurality of vertically extending conductors defining a skirt configuration depending from an upper end of said structure in spaced relationship to the structure, an electrically insulating support for supporting said vertical structure on said base means, a capacitive loading top hat means supported by and electrically connected to the upper end of the structure, said capacitive loading top hat means being electrically connected to and supporting upper ends of the vertically extending conductors which are electrically interconnected by the top hat means, spreader means tensioning lower ends of said conductors downwardly relative to the upper end of the structure and maintaining those lower ends in horizontally spaced and electrically insulated relationship to a lower end of said structure and to said ground means, said electrically conducting vertical structure and said skirt configuration providing a transmission-line interaction, impedance transforming means between said vertical structure and said electrical ground means and including inductive impedance transforming means for optimum impedance matching of the antenna system at said lowest frequency, coupling means for coupling radio frequency signals between a transmission feed line and said antenna system, said coupling means comprising capacitive coupling means between said transmission feed line and a lower portion of said skirt configuration, said impedance transforming means providing at said lowest frequency in combination with said coupling means, the transmission-line interaction between the skirt configuration and the electrically conducting vertical structure, and said capacitive loading top hat means on said structure, a physically short antenna having low ohmic losses and high efficiency.

* * * * *